US008615828B2

(12) United States Patent
Schermel

(10) Patent No.: US 8,615,828 B2
(45) Date of Patent: Dec. 31, 2013

(54) MULTI-POSITION RECLINING BED

(76) Inventor: Ferdinand Schermel, Brampton (CA)

( * ) Notice: Subject to any disclaimer, the term of this patent is extended or adjusted under 35 U.S.C. 154(b) by 839 days.

(21) Appl. No.: 10/772,331

(22) Filed: Feb. 6, 2004

(65) Prior Publication Data

US 2005/0000020 A1 Jan. 6, 2005

Related U.S. Application Data

(60) Provisional application No. 60/446,092, filed on Feb. 10, 2003.

(51) Int. Cl.
*A47C 20/08* (2006.01)
*A47C 17/16* (2006.01)
*A47C 1/035* (2006.01)

(52) U.S. Cl.
USPC ..... 5/618; 5/635; 297/411.31

(58) Field of Classification Search
USPC ..... 5/617, 618, 619, 624, 507.1, 503.1, 5/635, 925, 926; 108/43; 297/320–322, 297/217.3, 174 R, 83, 84, 411.31
See application file for complete search history.

(56) References Cited

U.S. PATENT DOCUMENTS 3,574,399 A * 4/1971 Udden ..... 297/423.37
4,258,445 A * 3/1981 Zur ..... 5/614
4,287,620 A * 9/1981 Zur ..... 5/615
4,290,423 A * 9/1981 Kleinwolterink ..... 5/83.1
4,409,695 A * 10/1983 Johnston et al. ..... 5/601
4,494,259 A * 1/1985 Miller et al. ..... 5/616
4,675,926 A * 6/1987 Lindblom et al. ..... 5/618
4,800,599 A * 1/1989 Korchinski et al. ..... 5/618
4,821,351 A * 4/1989 Bergenwall ..... 5/618
4,862,529 A * 9/1989 Peck ..... 5/611
4,945,587 A * 8/1990 Ferro ..... 5/419
5,745,940 A * 5/1998 Roberts et al. ..... 5/727
6,115,861 A * 9/2000 Reeder et al. ..... 5/727
6,272,702 B1 * 8/2001 Uchida et al. ..... 5/600
6,315,319 B1 * 11/2001 Hanson et al. ..... 280/650
6,691,349 B2 * 2/2004 Blevins ..... 5/613
2004/0177445 A1 * 9/2004 Osborne et al. ..... 5/600

FOREIGN PATENT DOCUMENTS

DE 3516045 11/1986
EP O0332820 * 1/1989
EP 1092371 A1 * 4/2001
EP 1197170 4/2002
JP 2002331005 A * 11/2002
WO WO9730614 8/1997

* cited by examiner

*Primary Examiner* — Sunil Singh

(57) ABSTRACT a reclining bed that raises the upper body and legs above horizontal, but also allows the legs to recline below, the horizontal position. The resulting ergonomic benefits of sitting up for extended periods of time makes the desk specifically designed for such a bed a necessity.

17 Claims, 35 Drawing Sheets

MULTI-POSITION RECLINING BED

CROSS REFERENCE TO RELATED APPLICATIONS

Figure 1:
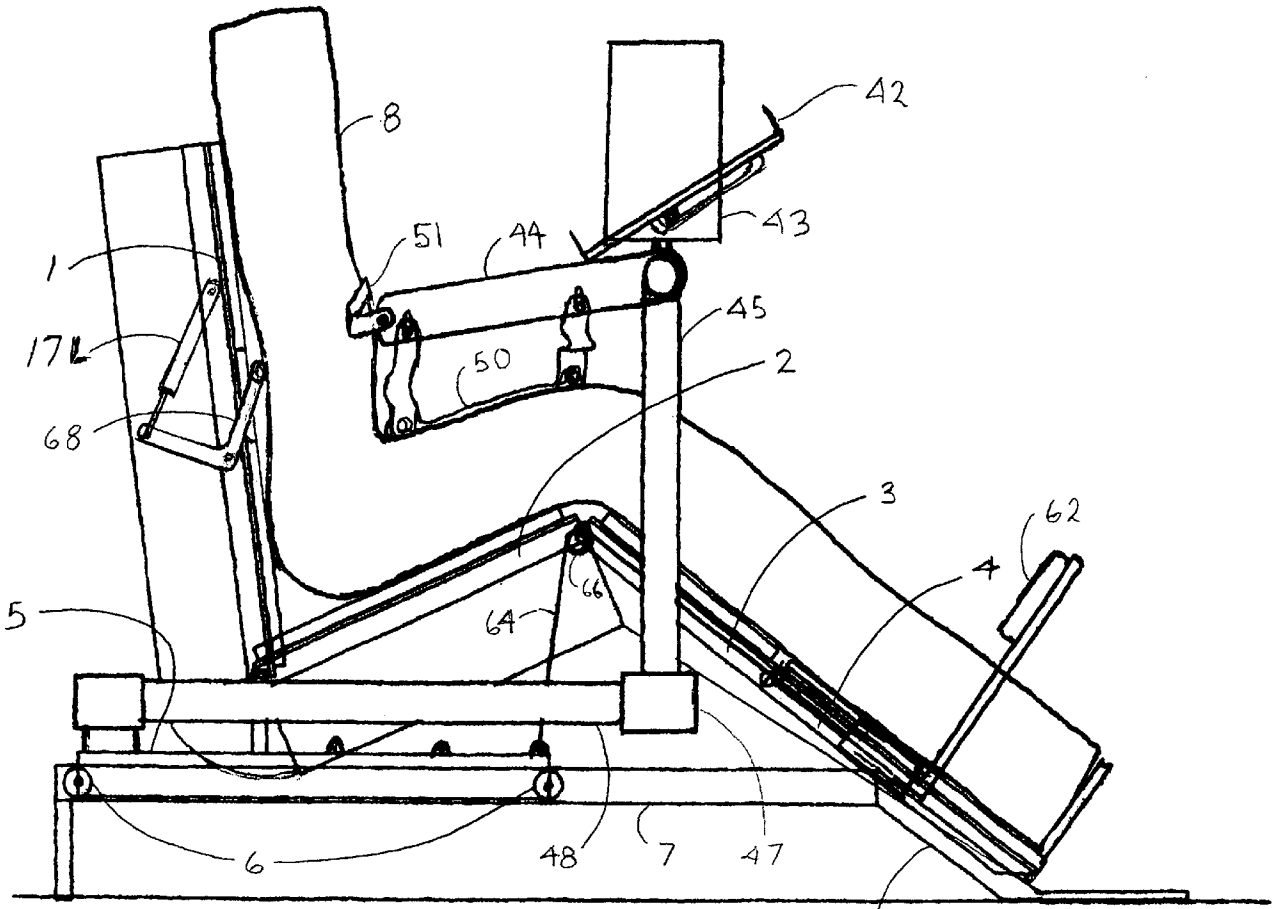

This application claims priority of provisional patent application

| | | |
|---|---|---|
| U.S. Pat. No. 60/446,092 | SCHERMEL | FEB. 10, 2003 |
| U.S. Pat. No. 20010000828 | HENSLEY | MAY 2001 |
| U.S. Pat. No. 5,537,701 | ELLIOTT | JULY 1996 |
| U.S. Pat. No. 3,916,461 | KERSTHOLT | NOVEMBER 1975 |

BACKGROUND

1. Field of Invention

This invention relates to multi-position reclining beds including new reclining features and attachable desk.

2. Description of Prior Art

Reclining beds were originally used in hospitals to allow patients to sit up in bed, allowing care takers to crank up the back section of the bed rather than arrange pillows and position the patient towards the head board of the bed and then having to lay them flat again. The reclining bed then allowed the patient, through a powered crank or motorized actuator, to change the incline of the back section of the bed. The reclining bed eventually became available for the general public, having the same powered back reclining feature as well as the elevated feet, calve and thigh section to raise above the flat rest position. Since this reclining bed dramatically improved the conventional single position flat bed, user satisfaction was immediately realized. The improvement was significant enough that public demand for more comfort was alleviated nor was further comfort conceived possible from a bed. The reclining bed added the wall hugging feature as seen in Elliott, to allow the end table to stay within reach of the user by moving the back section headward as it was reclined upward. (other sections also moved headward with back section)

The reclining chair with a blanket offered a warm sit-up furniture for watching television or reading and generally placed beside an end table, for drinks and under a lamp. The reclining chair evolved to further allow the user to bring the chair to a flat coplanar position, as seen in Kerstholt, however, such chairs comprised of three sections, back, thigh/buttocks and calve, and offered feet elevation without a horizontal calves section, resulting in the feet being pushed upward and shifting leg weight onto the knees. Kerstholt neither has a boxspring or mattress to tuck or sandwich sheets and blankets into such as a reclining chair, and should be classified as a chair for sleeping, not a wallhugger bed. The point at which a chair becomes a bed may be determined by the following:

a) if sheets, blanket and mattress are a permanent part of the furniture.
b) the size of surface being wide and long enough to facilitate sheets blankets. A standard adult mattress is 36 inches wide by 80 inches long.
c) sheets and blankets would tuck in-between a boxspring and mattress rather than draped over a chair.
d) the width being sufficient to allow a sleeping person to roll from one side to their back to their other side. If this is not the case the furniture should be classified as a cot, lawn chair, or reclining chair.

e) the length being sufficient to facilitate a pillow clearance above the head, and clearance at foot end to allow the feet of the person to not only rest on the mattress but sufficiently inward to allow blankets to remain sloped.
f) the mattress is independent from the surface.
g) the compressibility of the mattress or independent cushion suitable for sleeping rather than sitting.

The reclining bed has the long felt but unrealized disadvantage of ergonomic discomfort in that the body weight of the thighs was slightly shifted towards the buttocks and lower back area due to thighs and feet being raised beyond horizontal and inclined towards and thus bearing on the buttocks and lower back. At the same time the buttocks and lower back are also carrying the weight of the head, shoulders and back that would be transferred to the lower thighs (just above the knee area of the thighs) when sitting up fully in a chair, especially when leaning forward. This is readily felt when reclining in a typical lawn chair where the buttocks section is horizontal, especially when the calve section is also horizontal and no padding is present, even though the bodyweight of the back, head and shoulders is partially supported by the inclined back section. Three section chairs such as Kerstholt recognize the importance of the buttocks section being tilted. This ergonomic problem is also present with the present reclining beds but is masked or retarded by the effect of the mattress softness and the illusion that the body weight is transferred to the lower thighs since the mattress does touch this area. However with back reclined and more so with feet elevated simultaneously (fetal position), long periods in this position results in discomfort in the lower back and tailbone or buttocks due to this absence of weight transfer to the lower thighs. The fetal position also results in discomfort due to the diaphragm being squeezed by the additional weight not being transferred to the lower thigh area, even though it appears to be similar to the full sit up position, the body is generally horizontal and not vertical. There very few situations where the human body is held in the horizontal fetal position in the natural world unless suspended in liquid or floating, when there is virtually no body weight.

The applicant's invention solves this problem with a bed that will move into a full sit up position and body weight transfer to the lower thigh area as well as feet. This development makes long term sitting up in bed possible and thus makes working and recreation of the full sit up position comfortable, hence making a desk, office and recreational device as part of the bed a necessity. The applicant also solves the problem of a standard reclining chair cannot be used with a standard office desk since it is difficult to slide into the location close enough to the desk and still allow entry and exit. The feet and arm rests would also hit the desk rear and drawers. People who work long hours behind the desk will benefit from the variation the reclining bed offers over the most comfortable office chair. Tables for beds exist basically for the purpose of eating during illness, rather than bed trays, and are detached from the bed for the practical reason for use of the same table for other patients, removal when not in use, adjustment for various reclined positions as well as body thickness and back pillow thickness. The eating period is usually short and reading or television require no table surface. The bed may also be required to be rushed into an emergency room and an attached desk would interfere with transport and accessibility. Home use does not require the dettachability of the desk, but this has not been realized and hence invented as part of the bed. The ergonomic time limitation before discomfort is felt has also prevented the need for a desk to be realized or identified. The reclining bed is recreationally used for reading or television. The use for writing or lap top computer work is not commonly realized, desired or practiced since:

a) writing and computer work is not expected or possible for people in the hospital.

b) computers require electrical and phone jacks for internet connection and possibly desk space for supporting paper work, diskette availability, etc., making it simpler to just get up and go to the desk since the user has to get up any way to get the computer. The recent availability of lap tops has made the bed office viable as files, phone numbers and other various written information do not have to be retrieved from filing cabinets or require desk space. Full size computers would be too awkward to move to a separate office location in the home.

c) internet connection of lap tops require accessible phone jacks in the bedroom which is the main reason that is not commonly realized and practiced d) tables used in hospitals are not common in bedrooms unless person is ill, and for non ill people a tray with support stands for "breakfast in bed" is sufficient.

e) the wall hugger reclining bed provides access to side tables generally located at head of bed to allow enter and exit of bed, for alarm clock, drink, or book.

f) beds are perceived to be used for activities prior to sleep g) sitting up with legs straight out is intuitively realized to be uncomfortable for long periods h) an attachable desk on a bed that reclines and especially one that moves toward the wall while reclining is not conceivable, even for someone skilled in the art, to attach a desk and especially one with electrical wiring, for fear of crushing against the desk will reclining or electrical shorts to dangling wires.

J) hoisting devices are located along the head end of the bed for accessibility by hospital staff and for enter and exit accessibility.

The mattress has generally been placed on a boxspring, having legs for foot clearance and a covered with fabric to allow sheets and blankets to be smoothly slid sandwiched between them. It's primary function is to provide a rigid or semi rigid flat surface elevated from ground to allow feet to project under the bed when "making the bed". Most boxspring surfaces are no longer flexible but are usually made of a low cost chip board or thick cardboard. The conventional consumer perception of a boxspring similar in thickness to the mattress has prevented beds with single plywood sheet and long legs to be successful in the market place even with the reduction in material, delivery and storage cost benefit. This paradigm has made the reclining bed with leg sections dropping below horizontal inconceivable as well as impractical due to the short distance it may be able to drop rendering little gain for the added expense of such a feature. It would also be impractical to increase the overall height of the boxspring to allow for the necessary leg drop clearance since the overall height for sitting when the bed is flat would be high and uncomfortable not to have feet touching the ground. The reclining bed has several design problems that would make this feature of the leg section dropping below the horizontal position very difficult;

a) pivot point between the buttocks section and the thigh section requires a pivot point at the same elevation but under the knee area for the bottom pivot of the double bar linkage to elevate the calves section horizontally as it is recline in an upward or downward direction. This pivot point is named the "lower feet lifting bar pivot 23" of the "feet lifting bar 21" in FIG. 3. This pivot point must be secured to the frame or carriage and would prevent the leg sections from dropping below the horizontal position. If the pivot points were located outside of the drop area say on side boards, then the side boards would prevent two beds from sitting side by side with mattresses touching and the side boards would have to move along the floor to hug the wall as the back section reclines upward and a device to lock the calves section and thigh section coplanar would also have to be added.

b) the linear actuator needs to be centrally located width wise and since the back section reclining actuator is located centrally at the head of the bed, the feet elevating linear actuator has generally been placed below the calves section, thus preventing dropping of the leg section. The other main reason for the location of the linear actuator was that to prevent crushing to children during return to the horizontal position, the linear actuator is not connected to the feet elevating linkage for pulling but only for pushing, allowing return by free fall of the leg section to horizontal. As well the space limitation due to actuator size and symmetry and duplication of components, the actuator is located below the calves section.

C) since the wall hugger is dominating the market, over the non wallhugger, it became even more inconceivable that the leg section now moved further towards the head of the bed can be made to drop, since it would also have to drop through the carriage and carriage track and pedestal or track support structure as well as the pivot point.

SUMMARY

In accordance with the present invention, a reclining bed that provides the full ergonomic benefits of sitting up with the additional benefits of back arch support, foot rest, arm rest and blankets, all positions adjustable to allow shifting of weight makes this bed a more comfortable work place than any known desk and chair available and warrants the special desk to take advantage of long sitting periods now possible in this bed. This bed offers independence and many benefits to handicapped or seriously injured people.

DRAWING FIGURES

FIG. 1—A preferred embodiment assembly showing the main features

Figure 2:
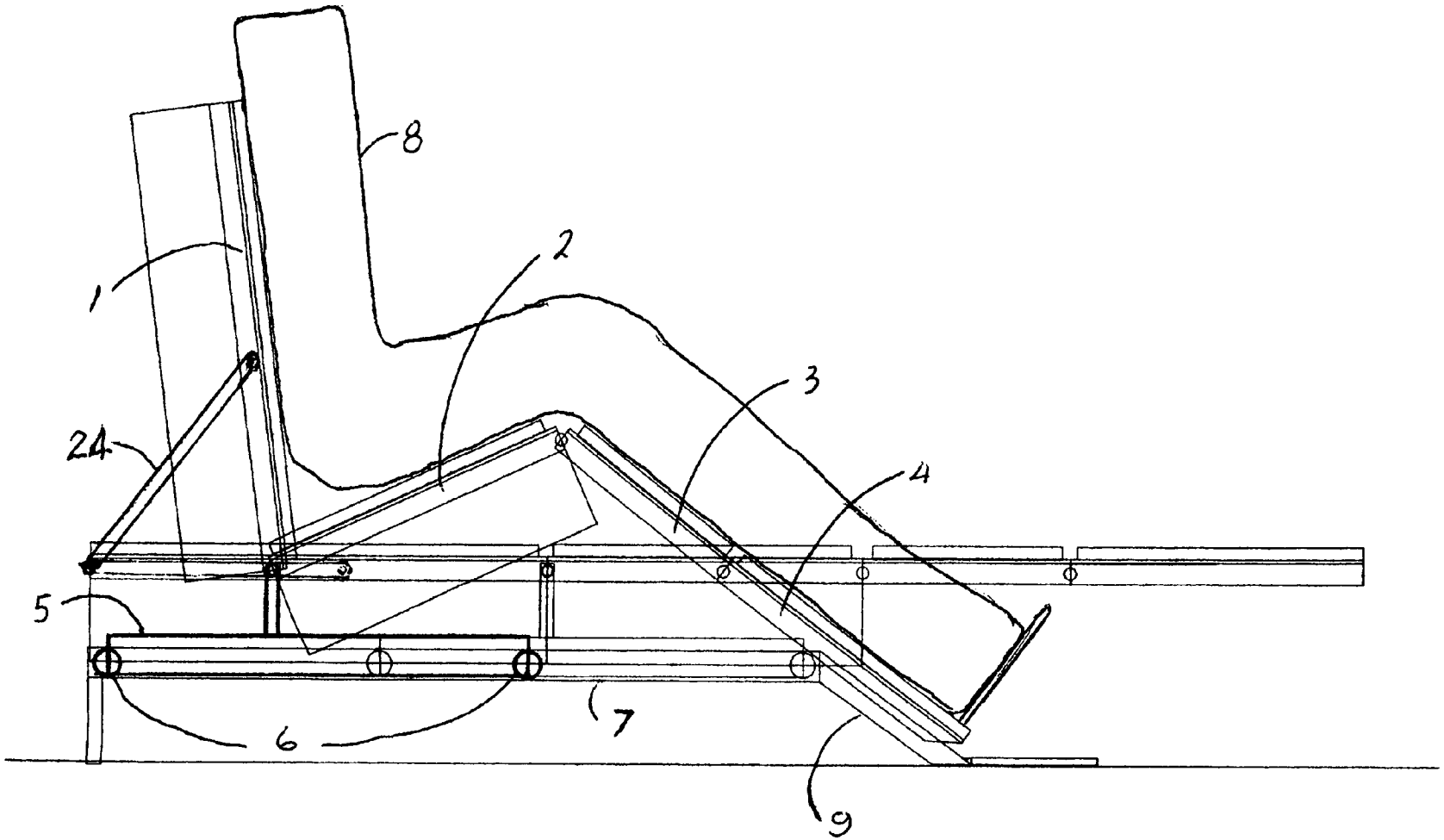

FIG. 2—Shows the bed sections in the horizontal and sit-up position with the mattress 8

Figure 3:
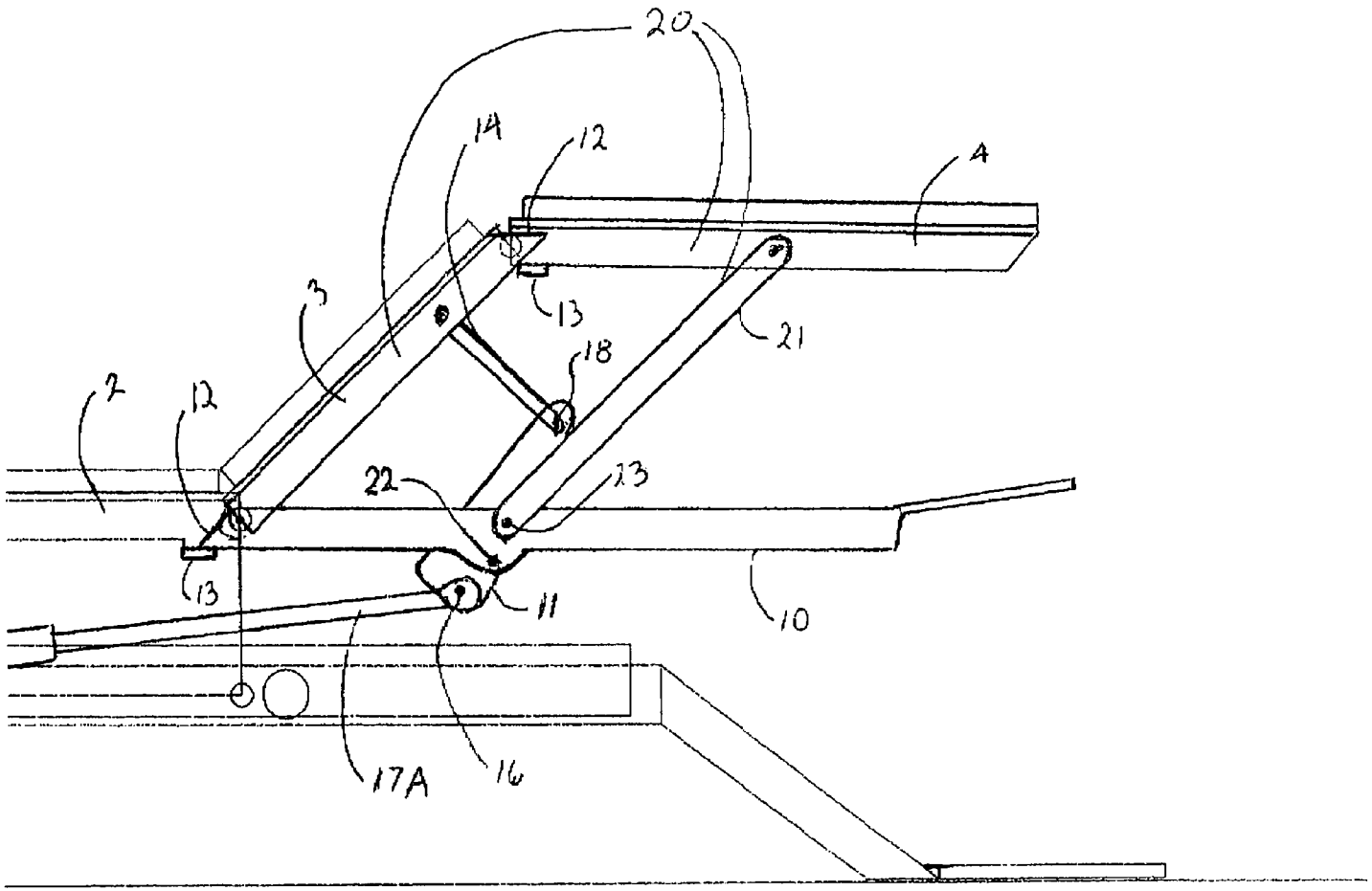
Figure 4:
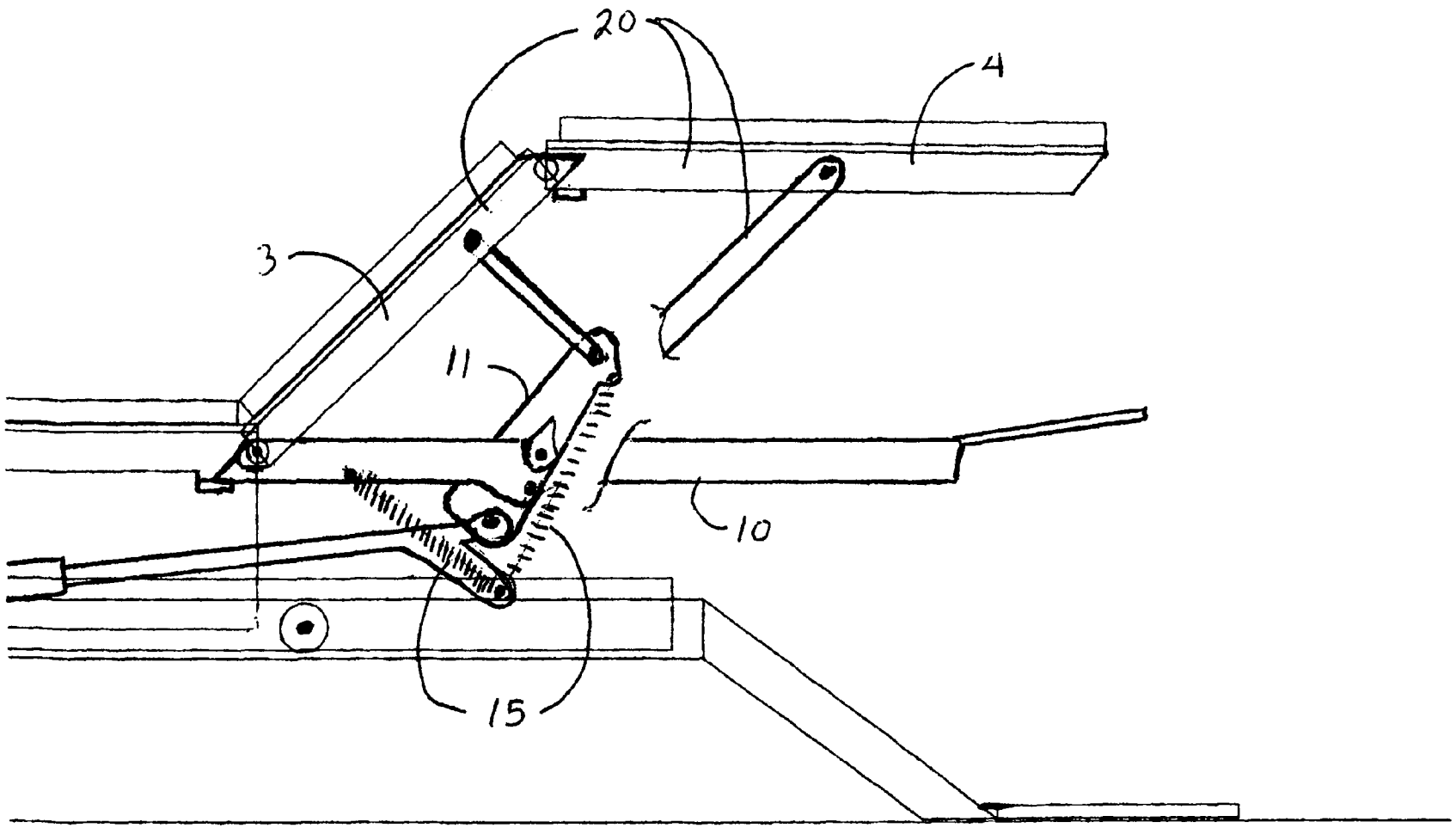
Figure 5:
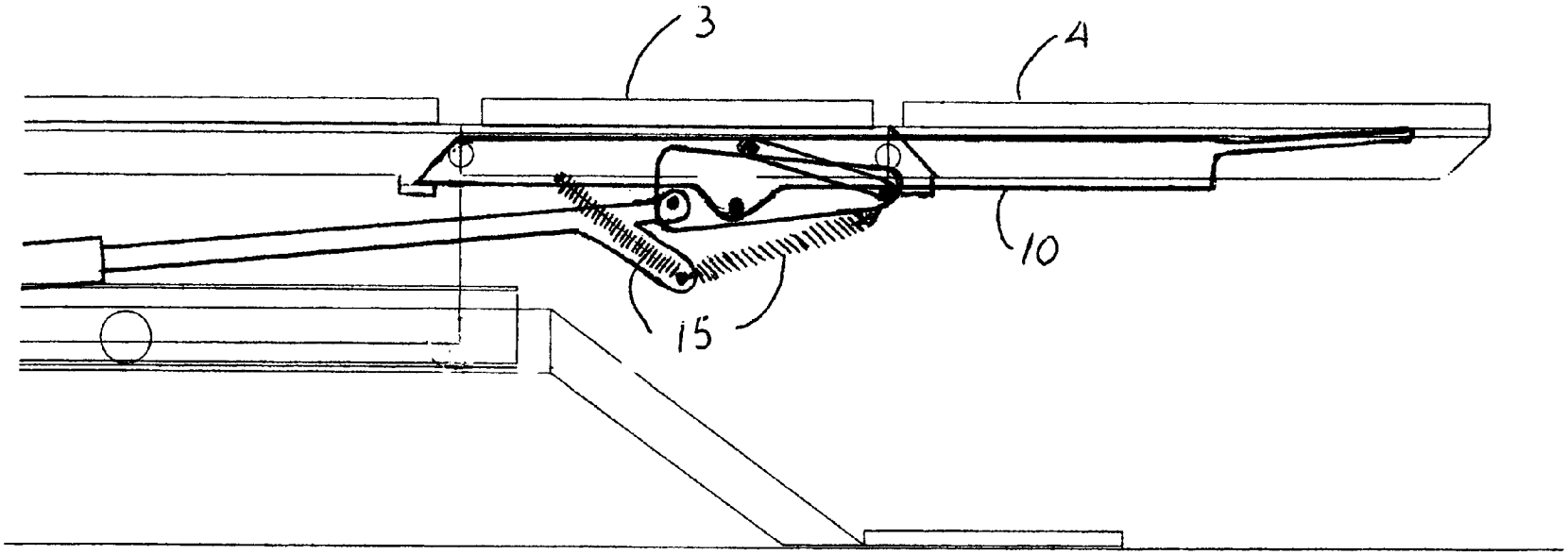
Figure 6:
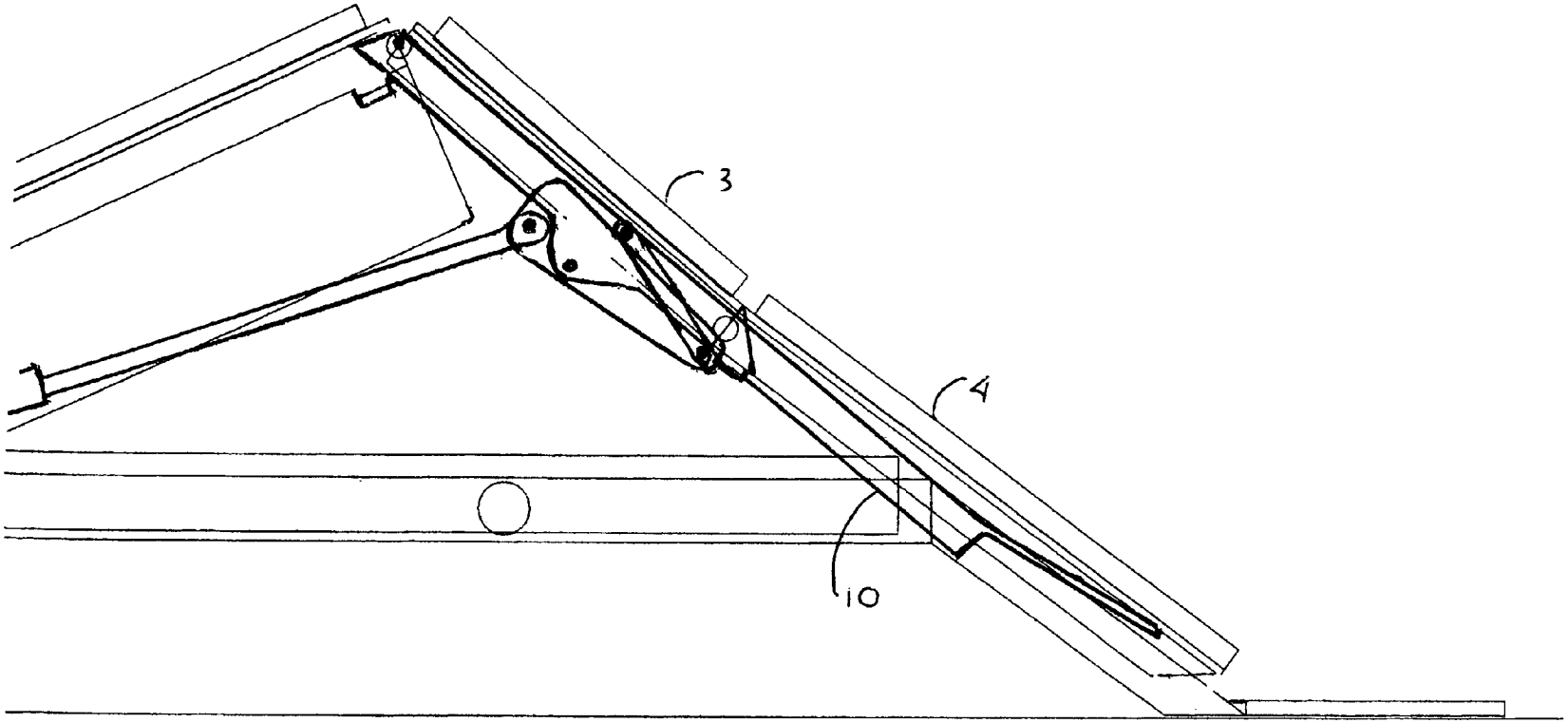

FIG. 3—Shows the bed calves section and thigh section mechanism in the feet elevated position FIG. 4—Shows two lock springs elongated, and their connection points, with the feet elevated FIG. 5—Shows the two lock springs in a less elongated or collapsed position with legs horizontal FIG. 6—Shows the locked coplanar thigh section and calves section and pivot fixture into a single rigid coplanar unit in the sit-up position.

Figure 7:
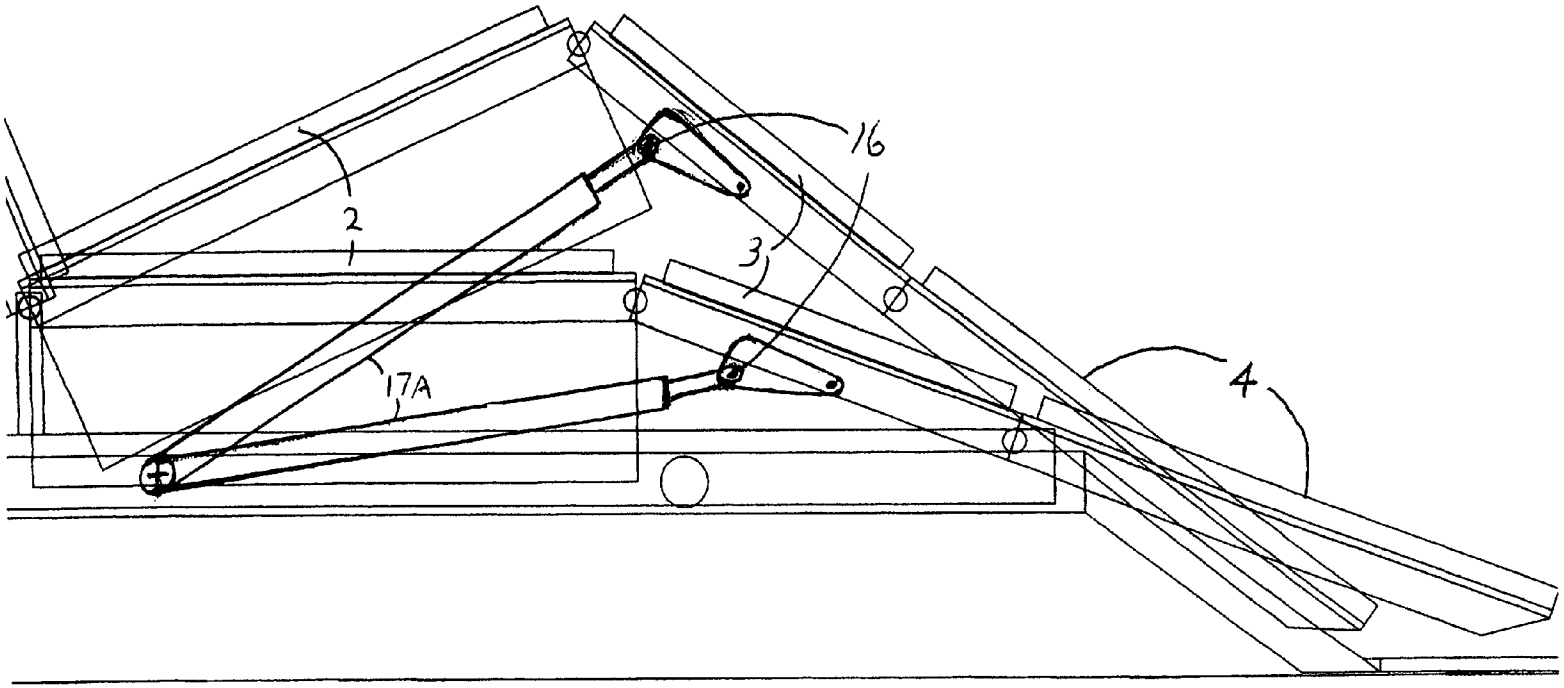

FIG. 7—Shows the disposed locations of the pivots and double bar linkage lengths to form a configuration that will result in substantially minor vertical movement of the foot edge when buttocks section is tilted.

Figure 8:
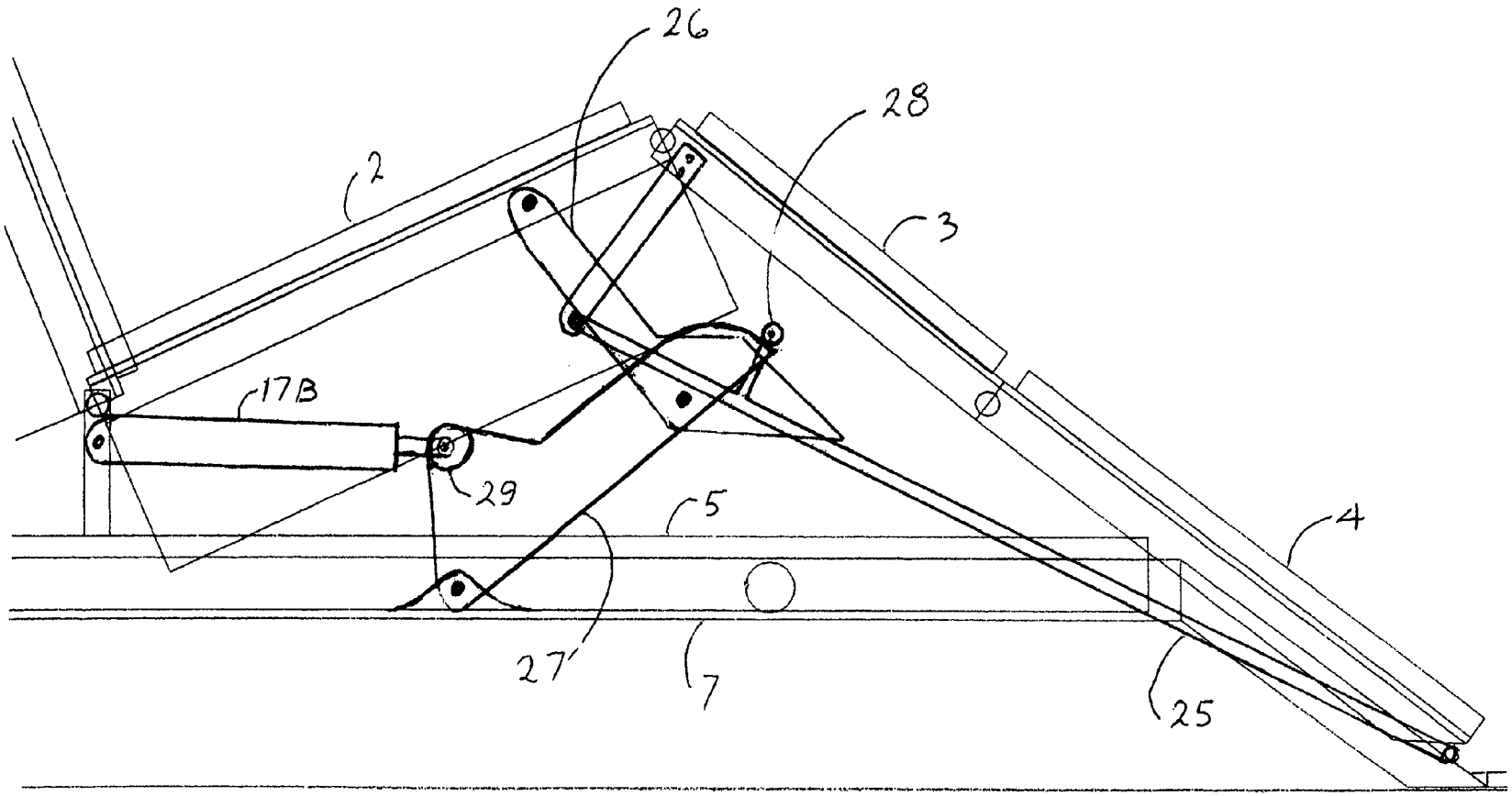
Figure 9:
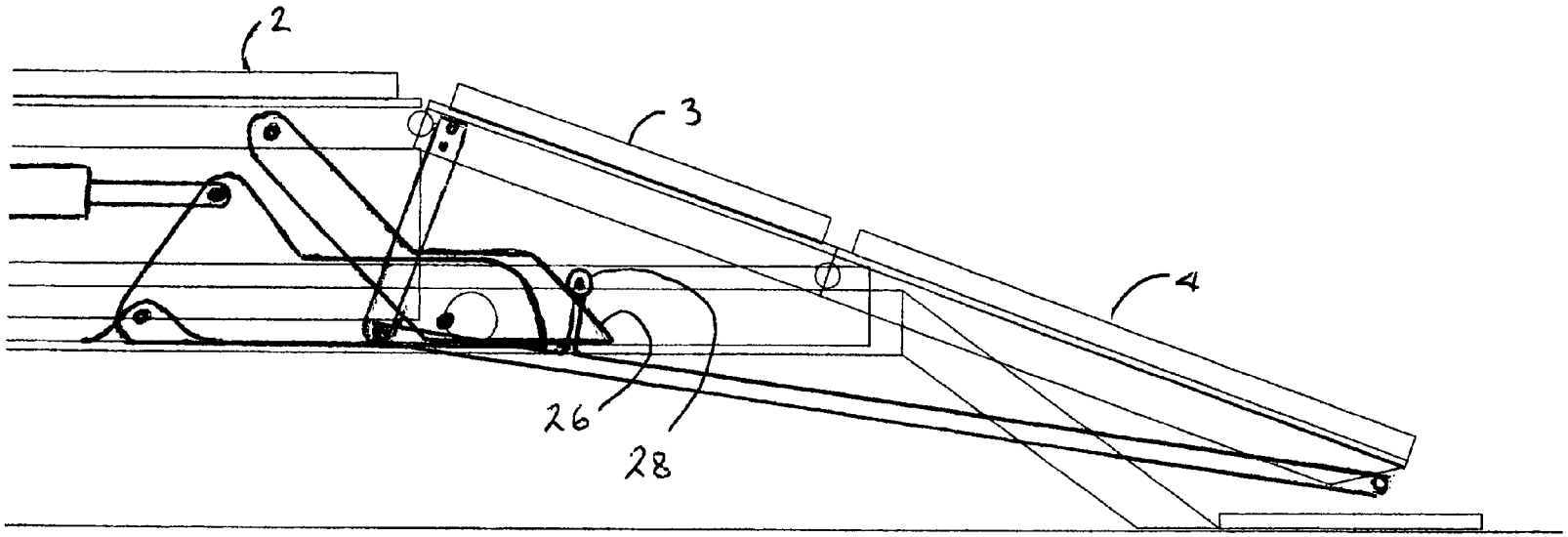
Figure 10:
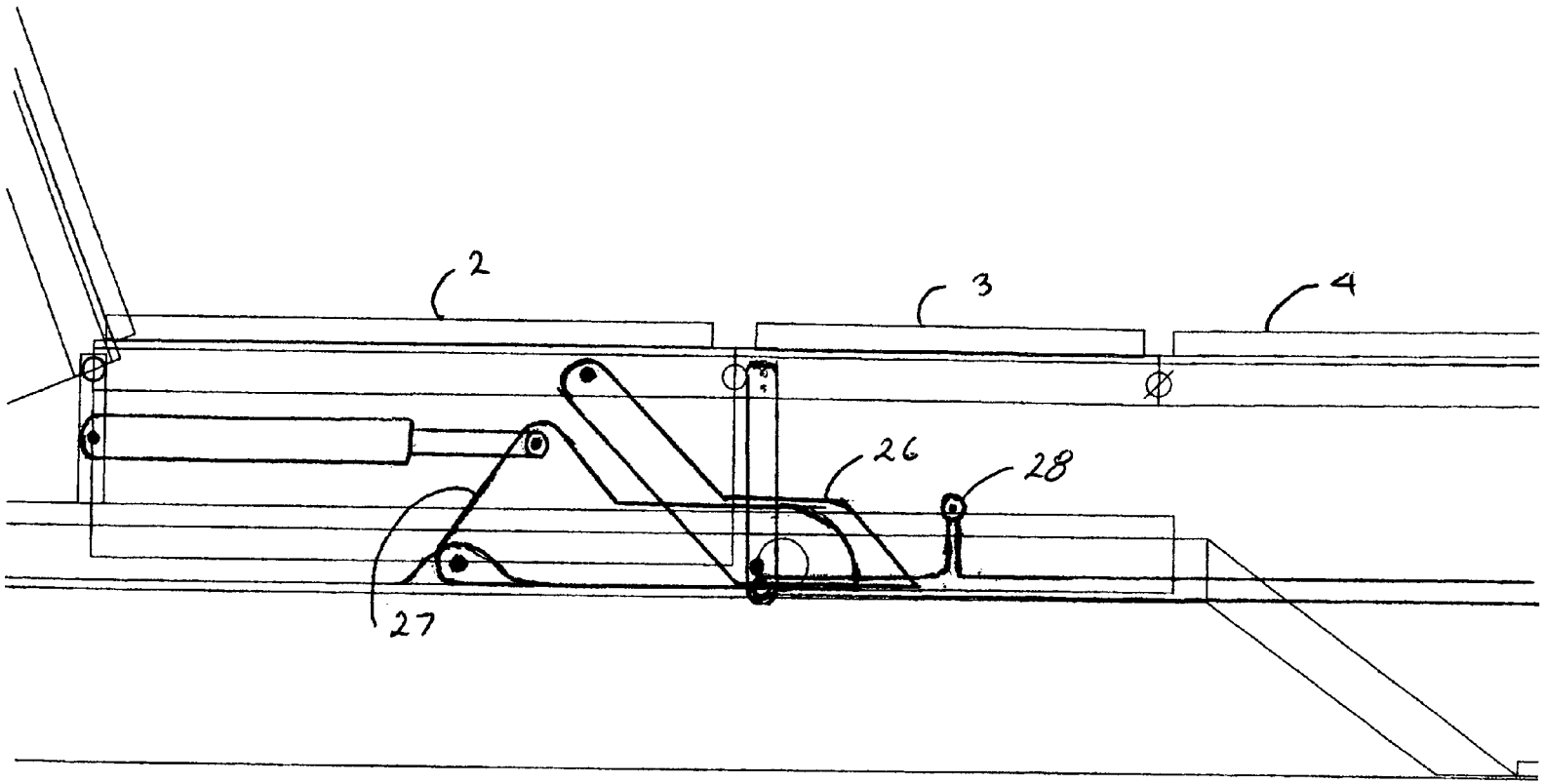
Figure 11:
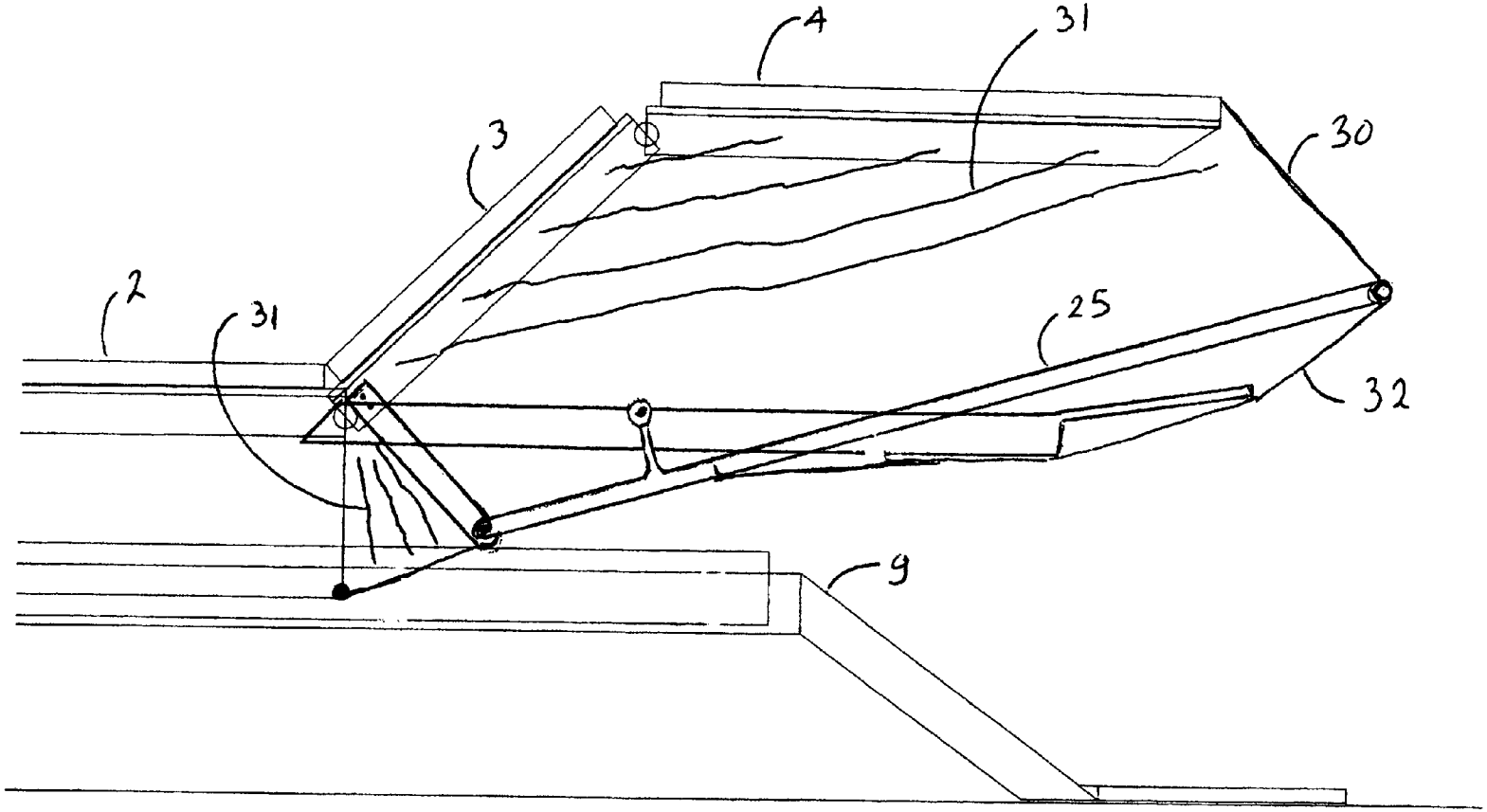
Figure 12:
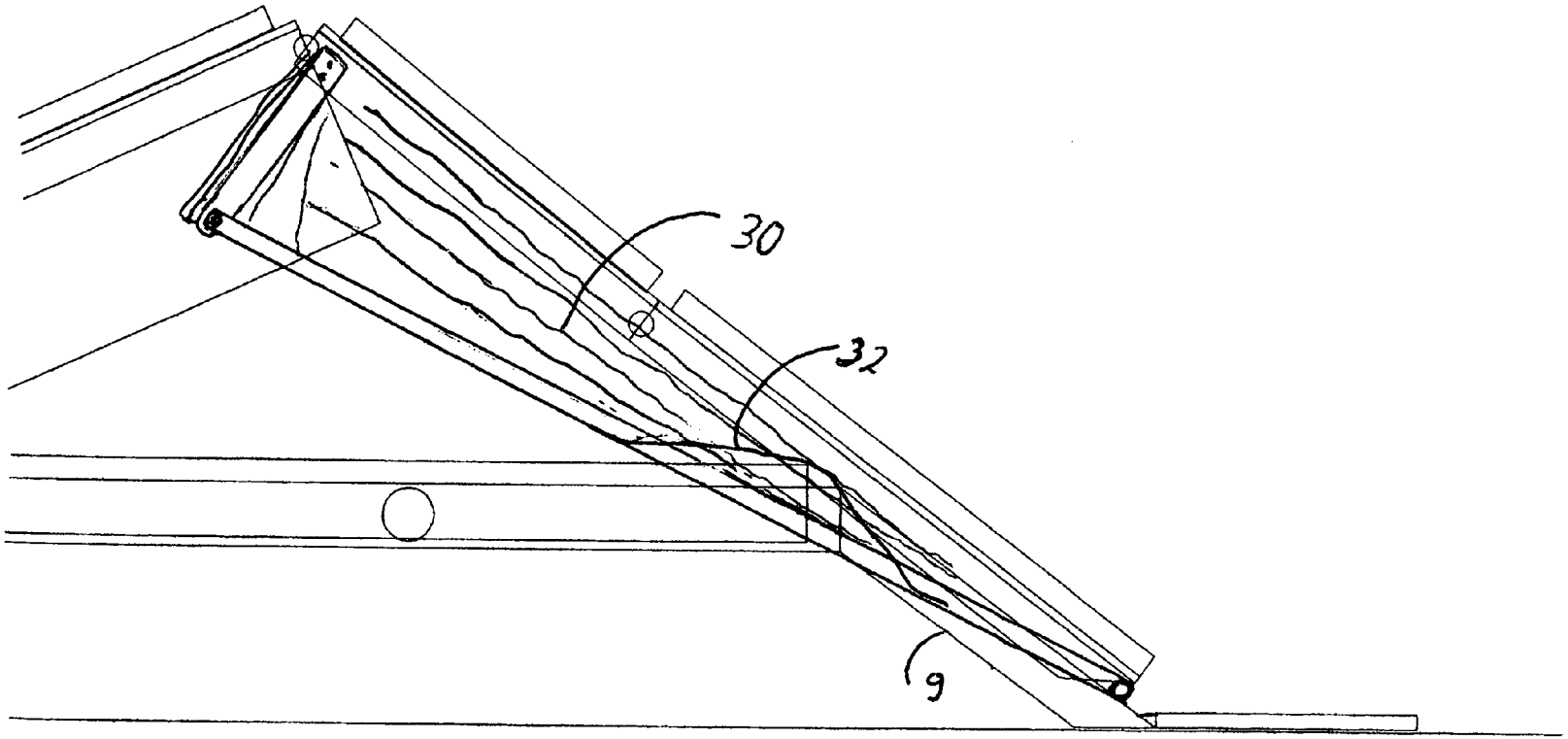
Figure 13:
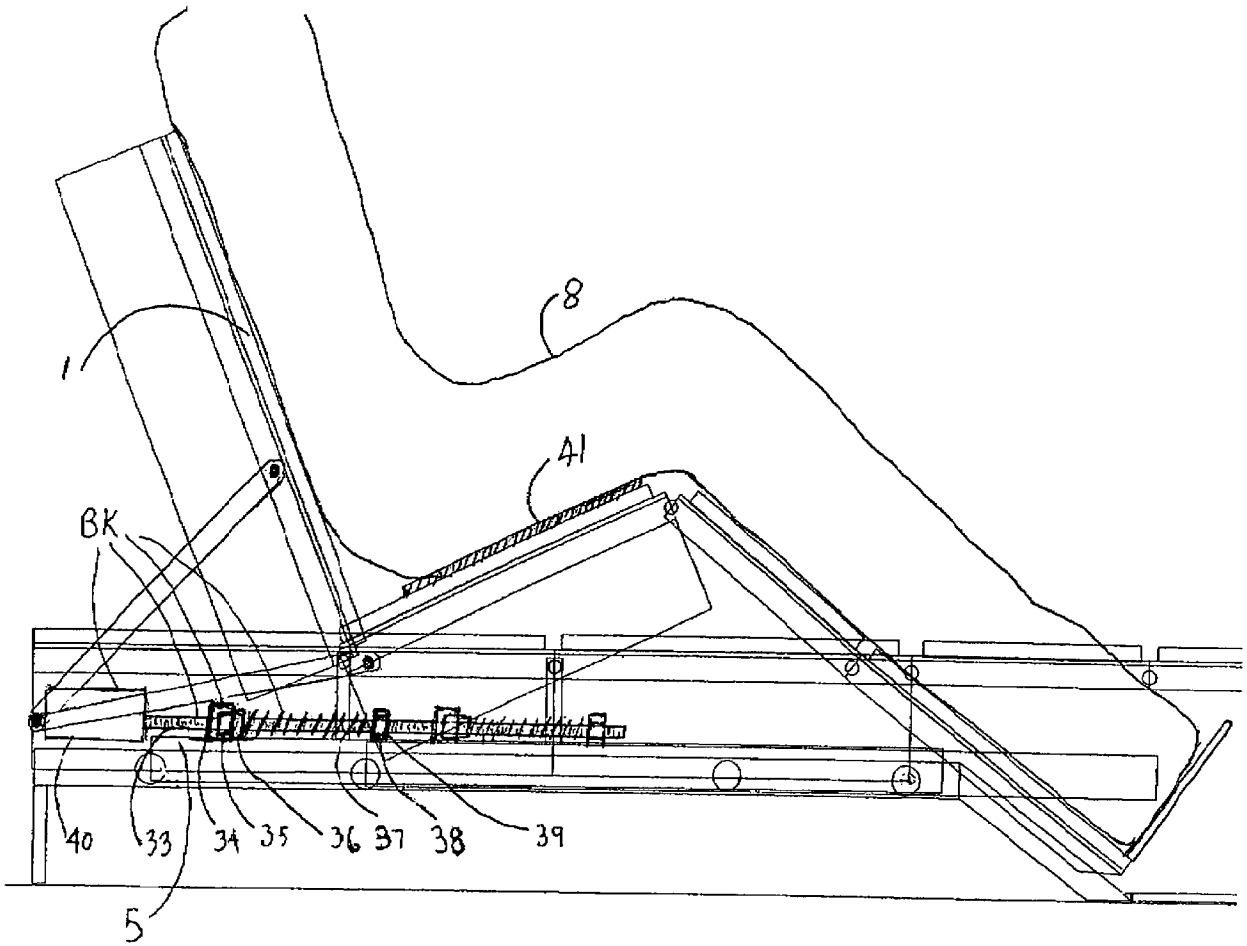
Figure 14:
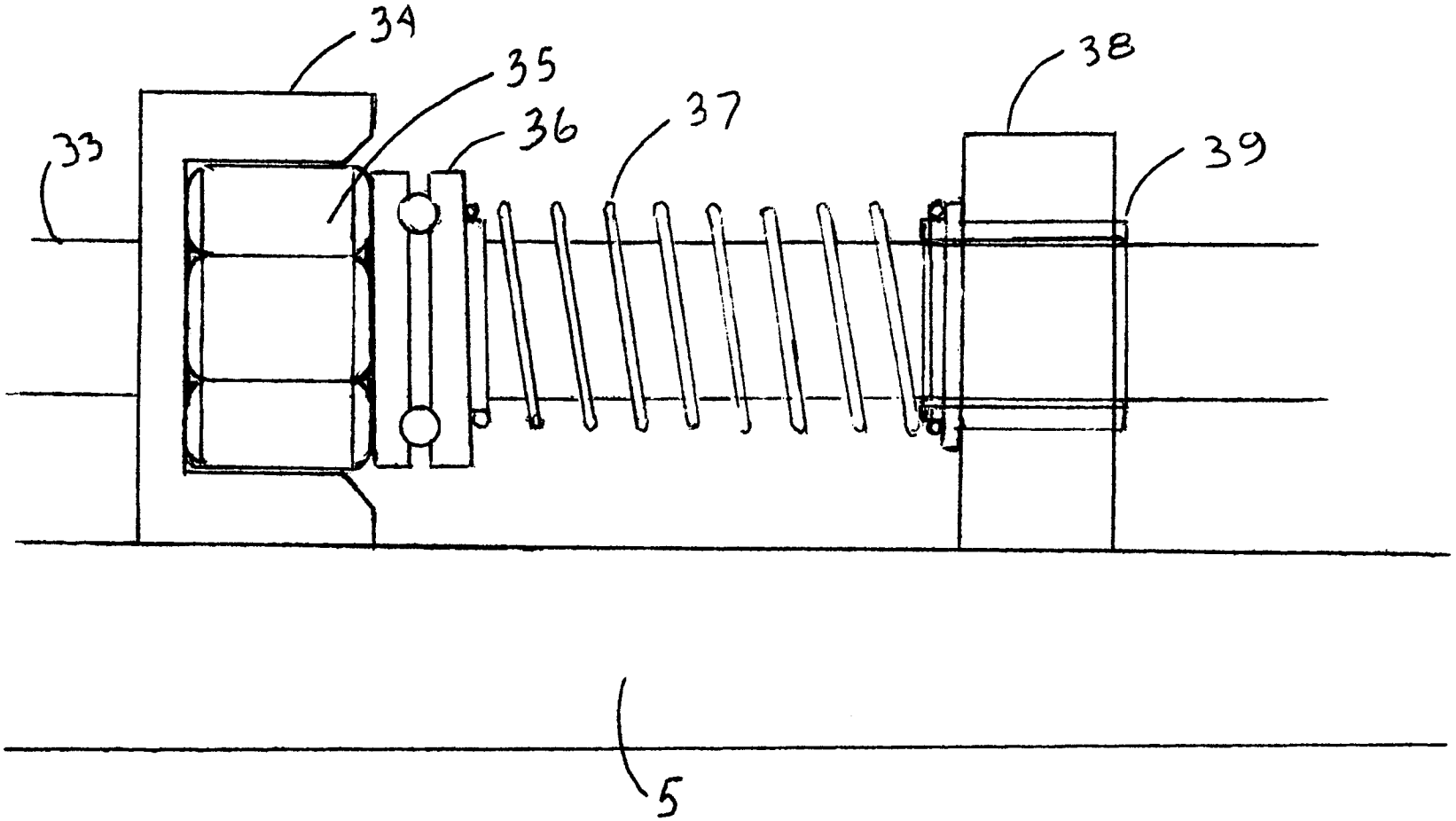
Figure 15:
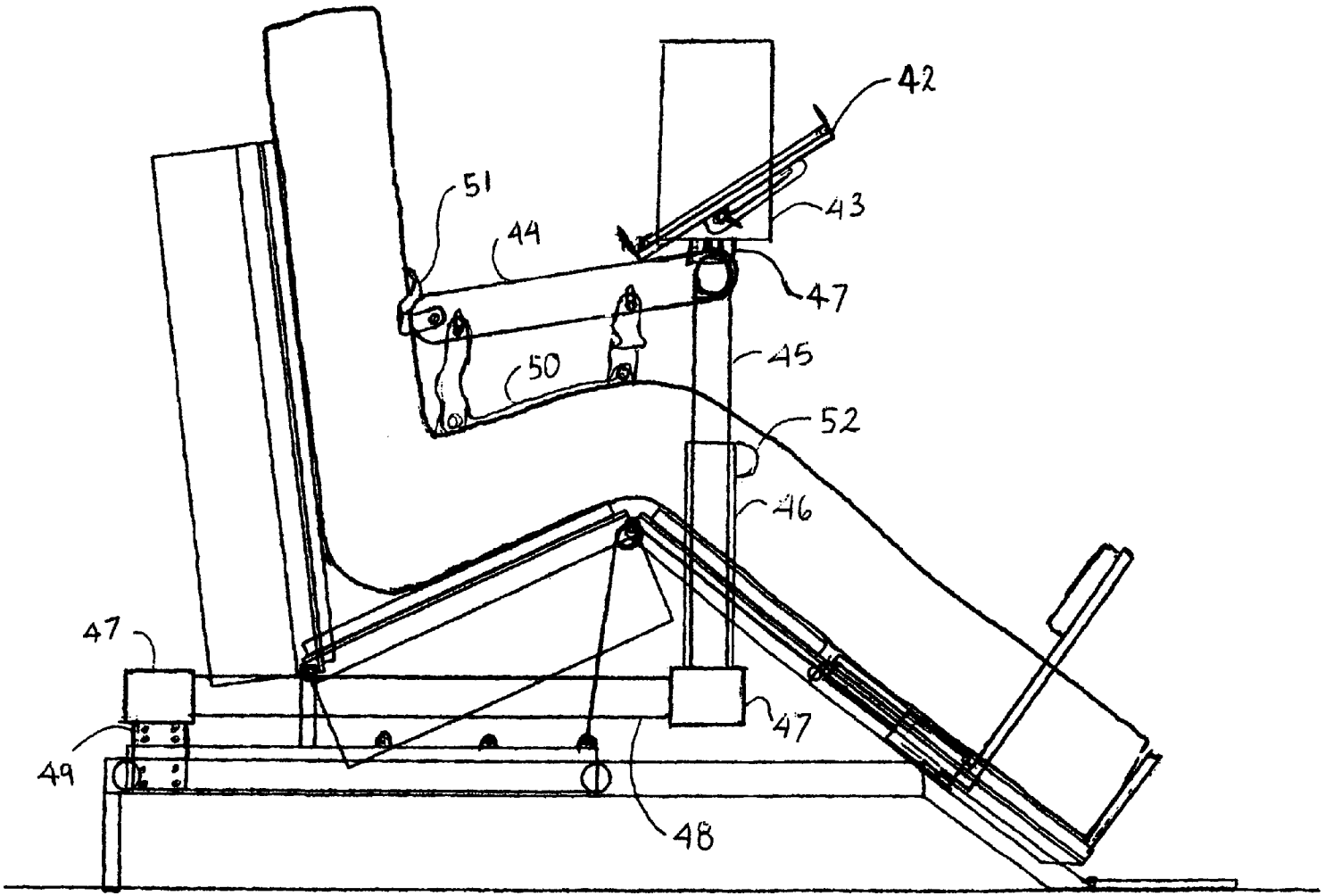
Figure 16:
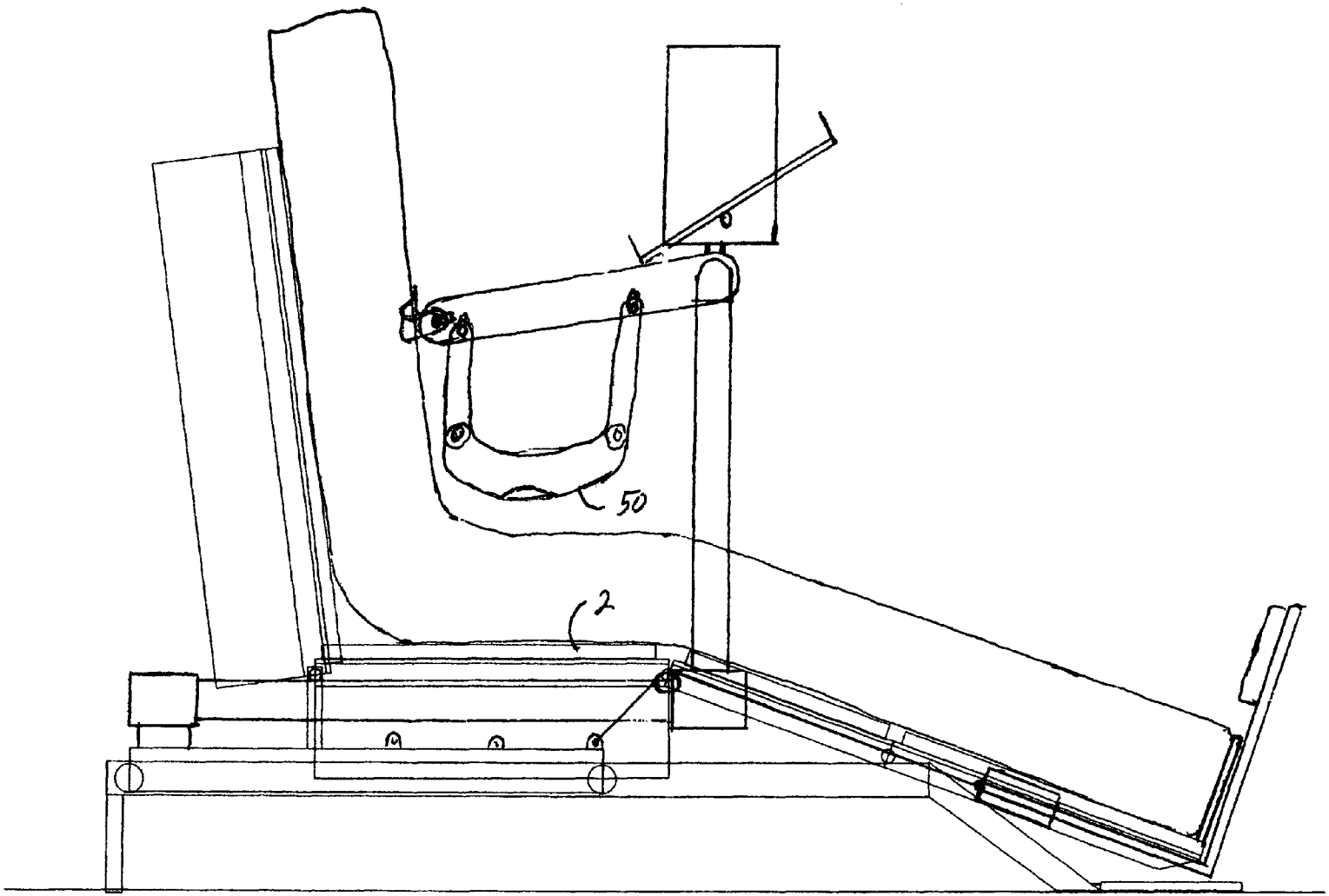

FIG. 8—Shows the buttocks section reclining mechanism with the collapsing boxspring cams and boxspring collapsed in the sit-up position FIG. 9—shows the bed with the buttocks section horizontal and the leg down with the collapsing boxspring cams and boxspring collapsed FIG. 10—shows the bed with the buttocks section, calves section, and thigh section horizontal and the cams and cam follower FIG. 11—shows the fabric covering of the boxspring with the feet elevated FIG. 12—shows the side fabric collapsed when the bed is in the sit-up position FIG. 13—shows the carriage linear actuator mechanism FIG. 14—Shows details of drive disconnect mechanism for carriage linear actuator FIG. 15—shows a side view of the bed with the desk assembly, foot rest assembly and buttocks sling FIG. 16—shows the buttocks section lowered and the buttocks sling elevated relative to the mattress.

Figure 17A:
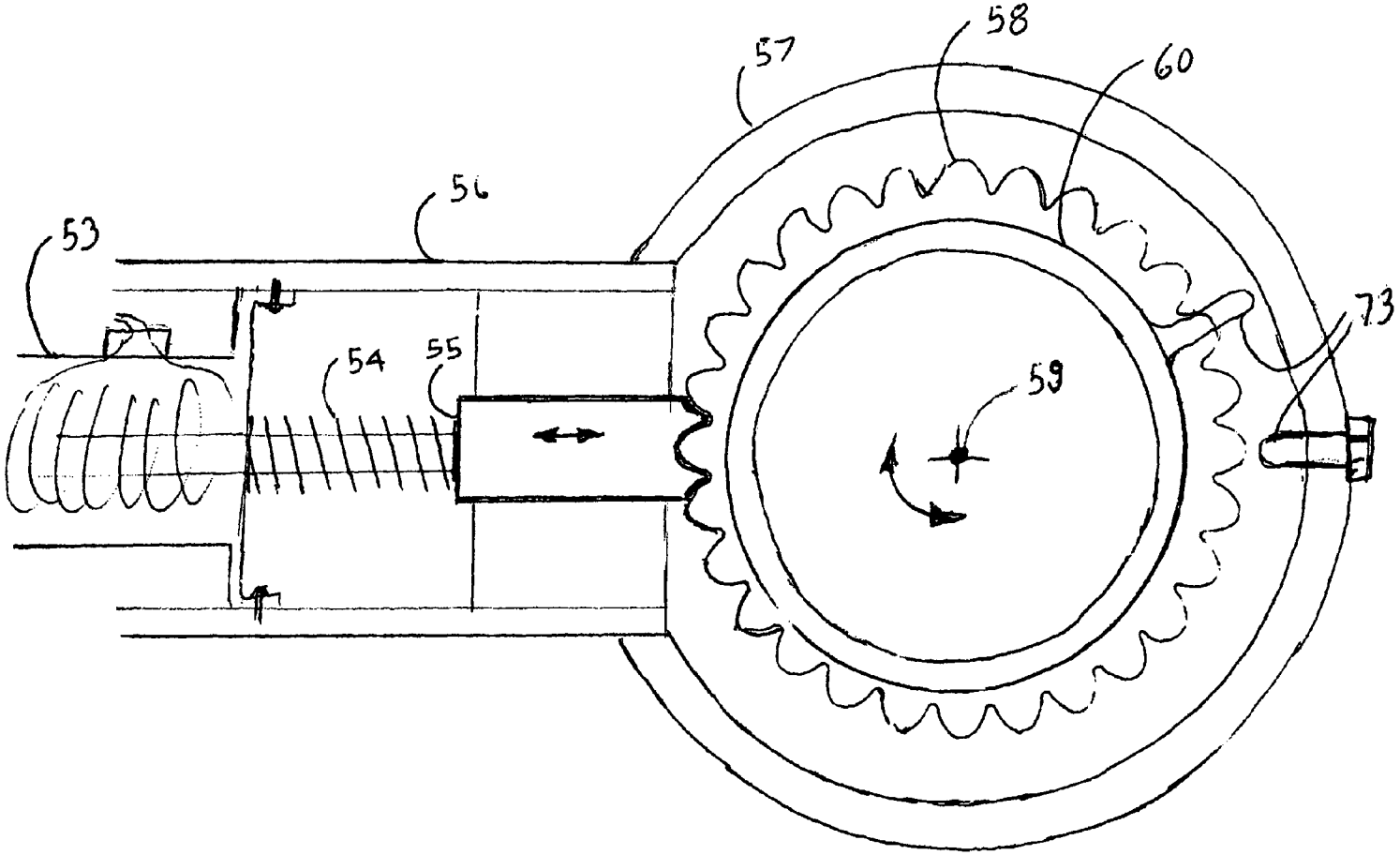

FIG. 17A—shows the top view of the swivel lock details

Figure 17B:
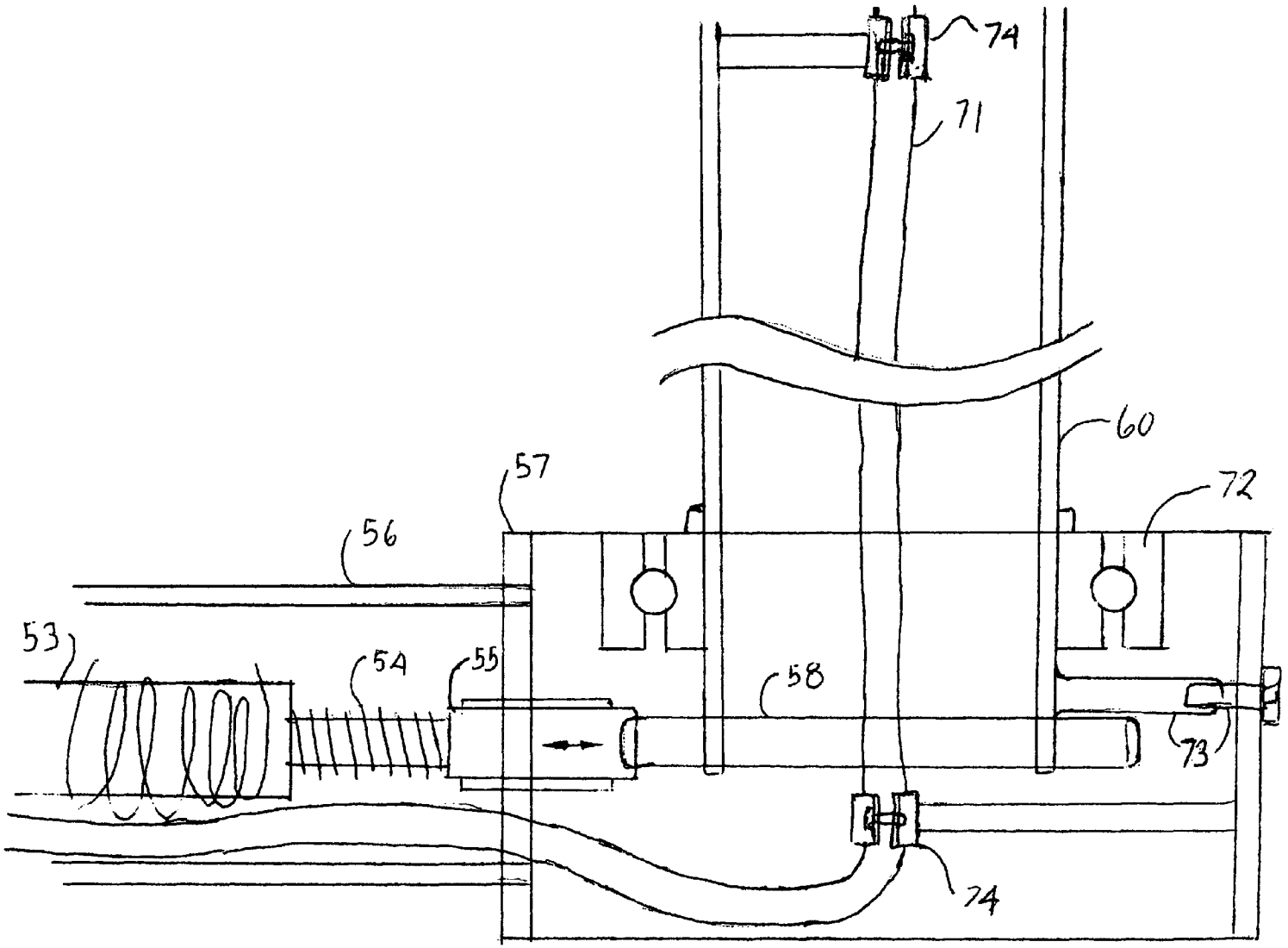

FIG. 17B—shows the side view of swivel lock details

Figure 18:
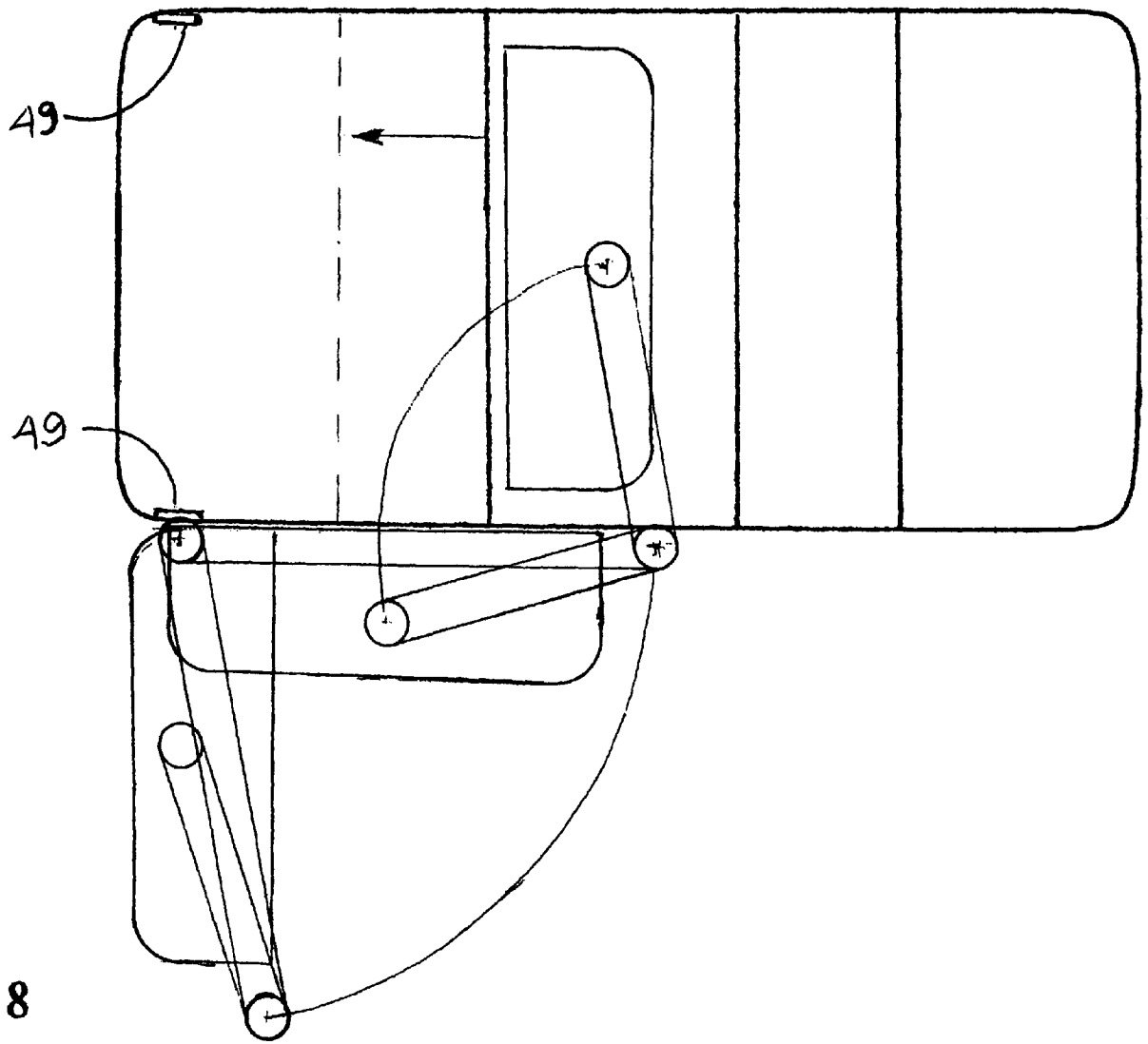
Figure 19:
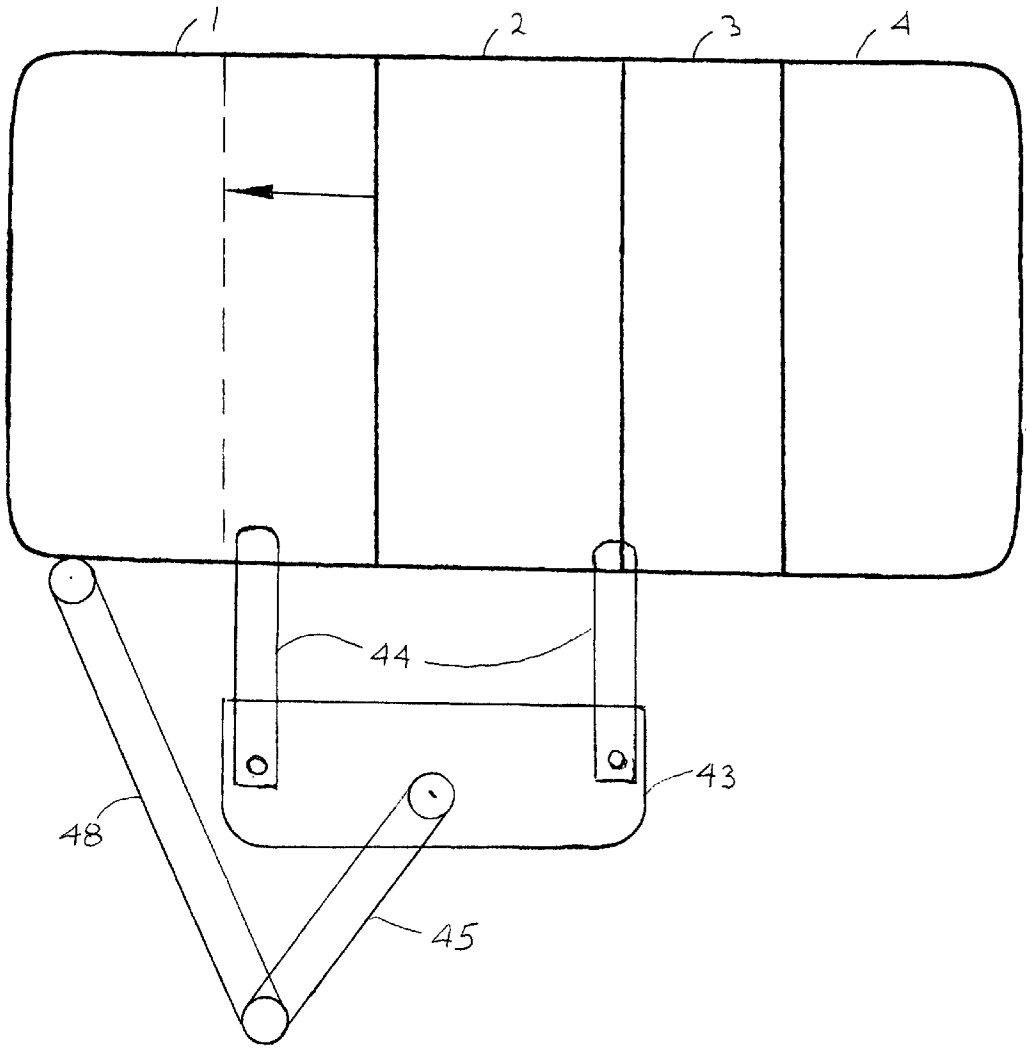
Figure 20:
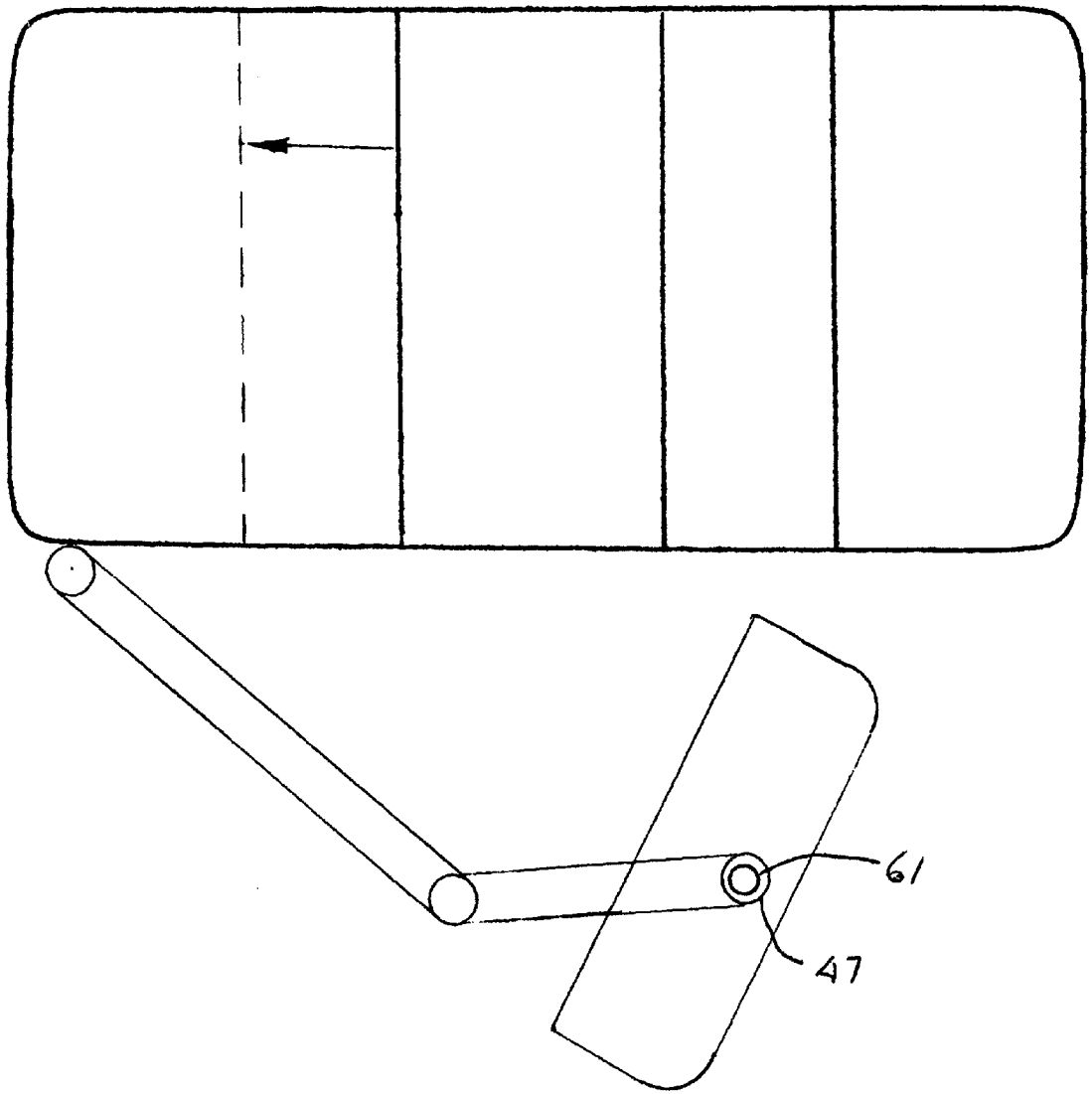
Figure 21:
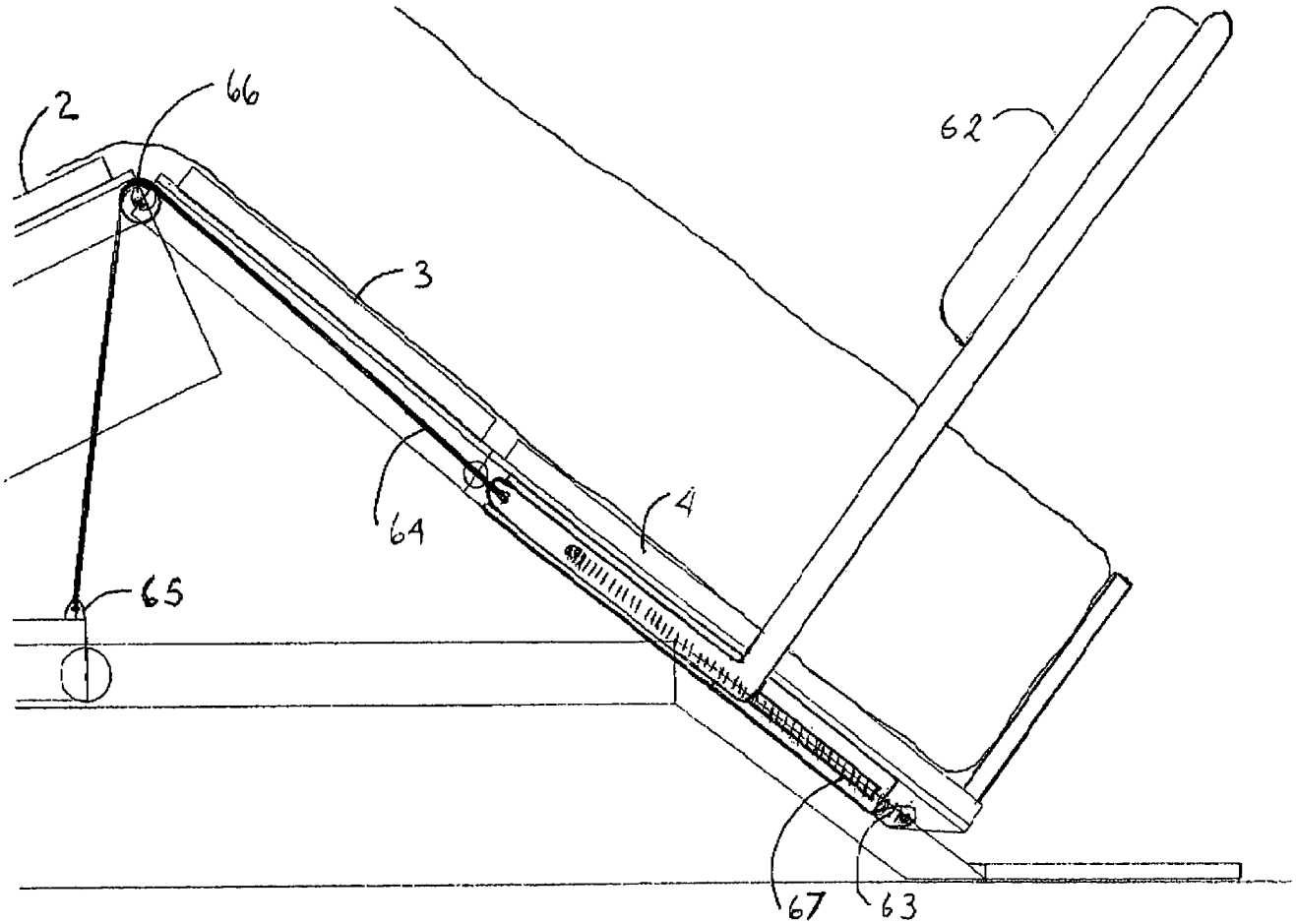
Figure 22:
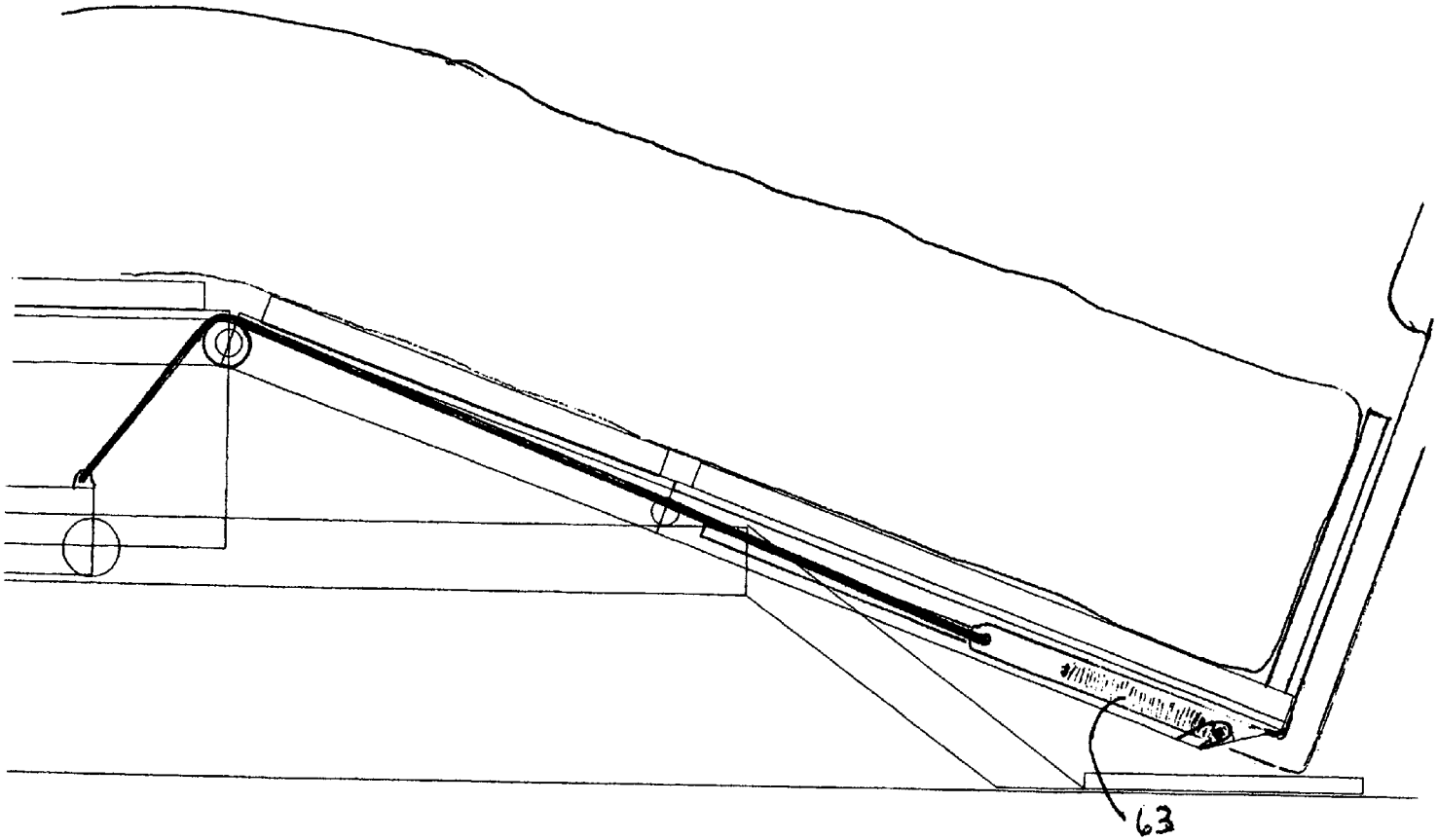
Figure 23:
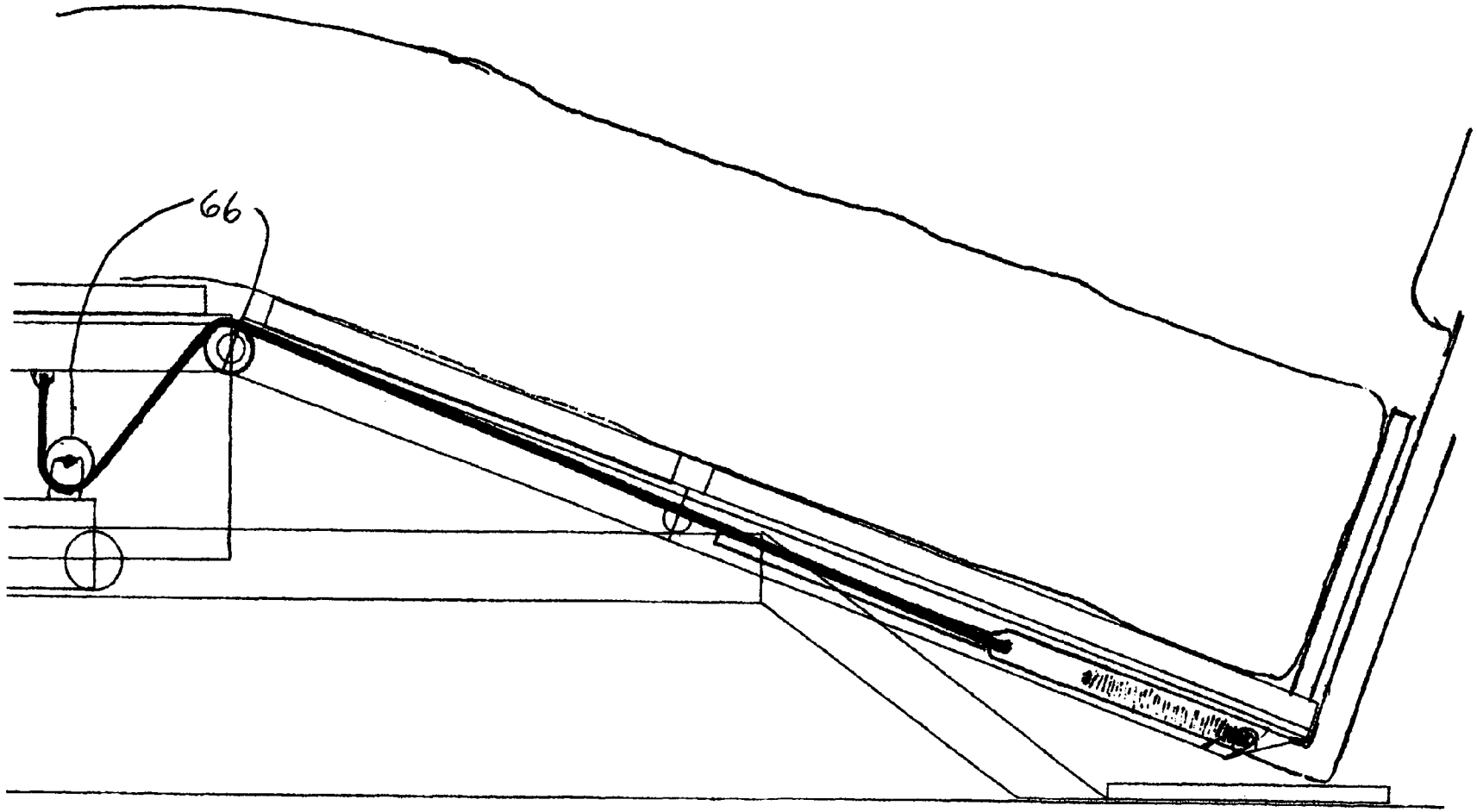
Figure 24:
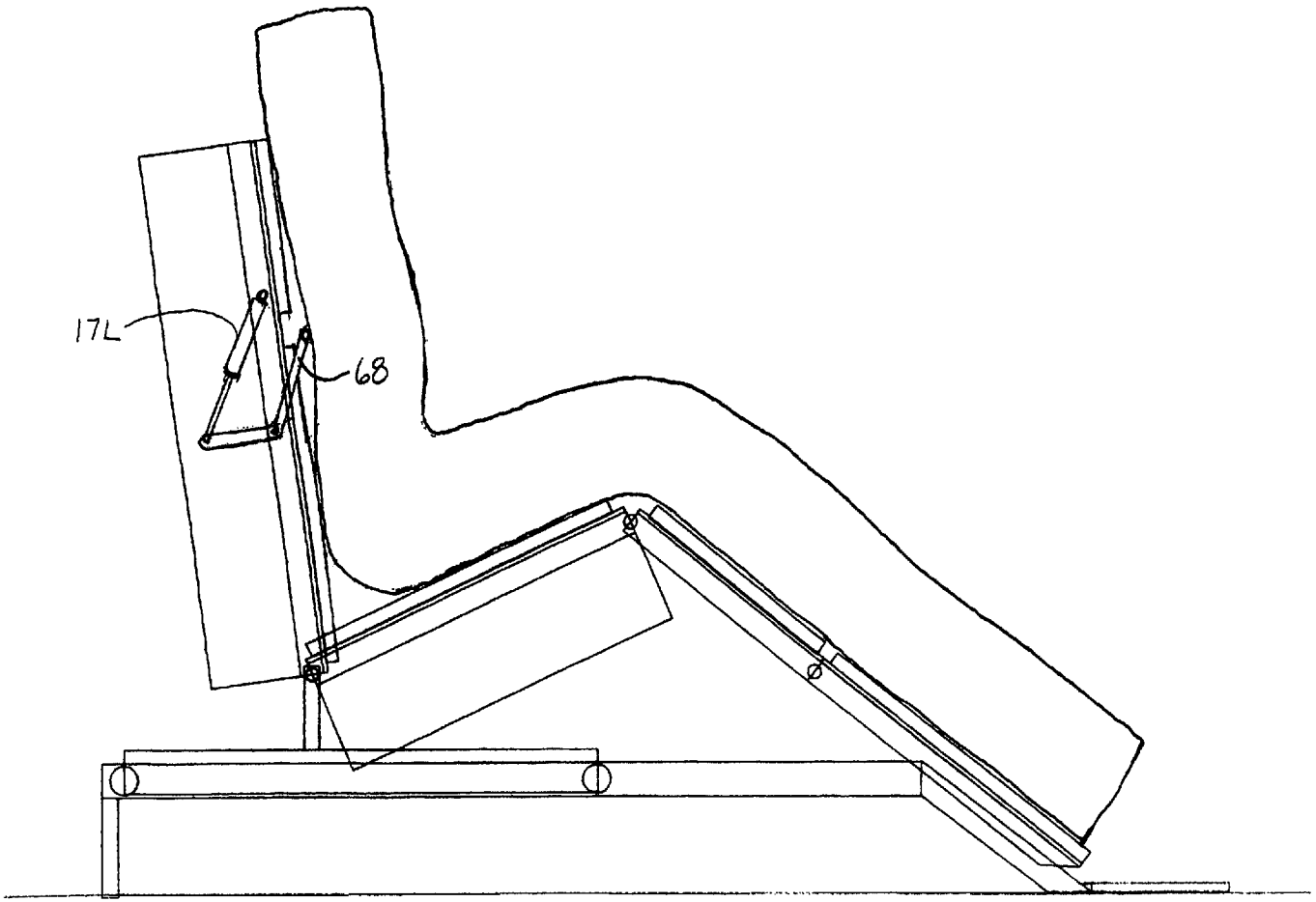
Figure 25:
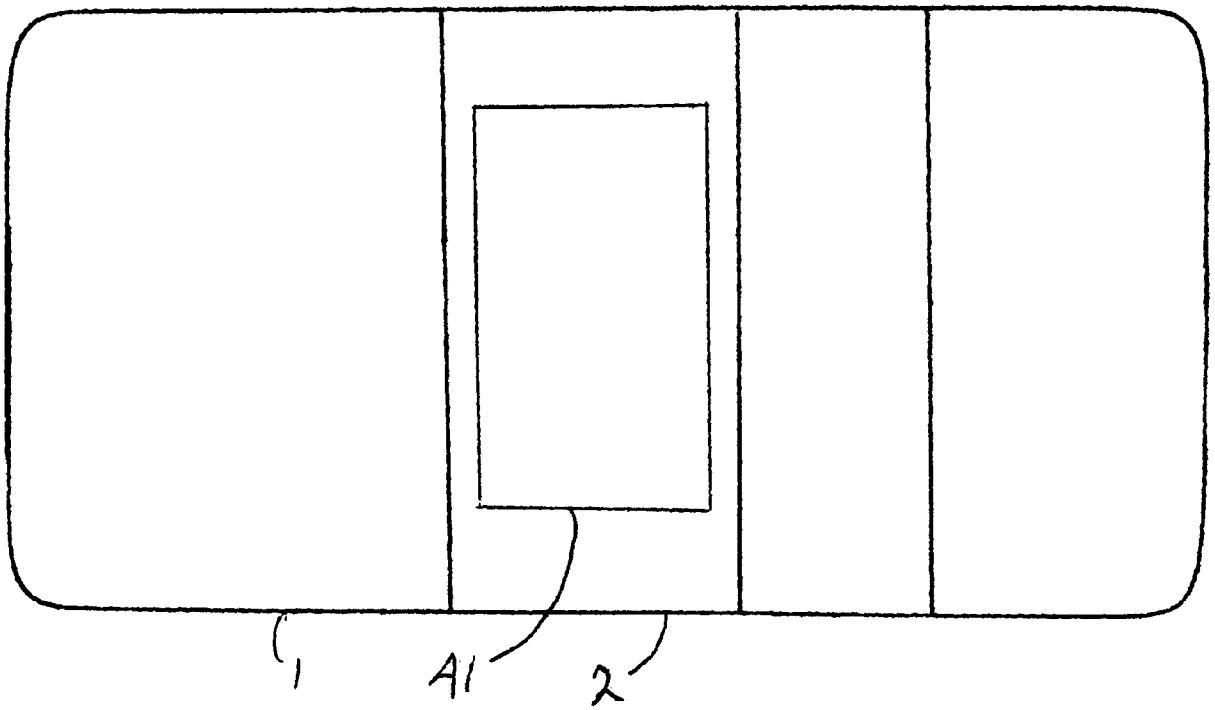
Figure 26:
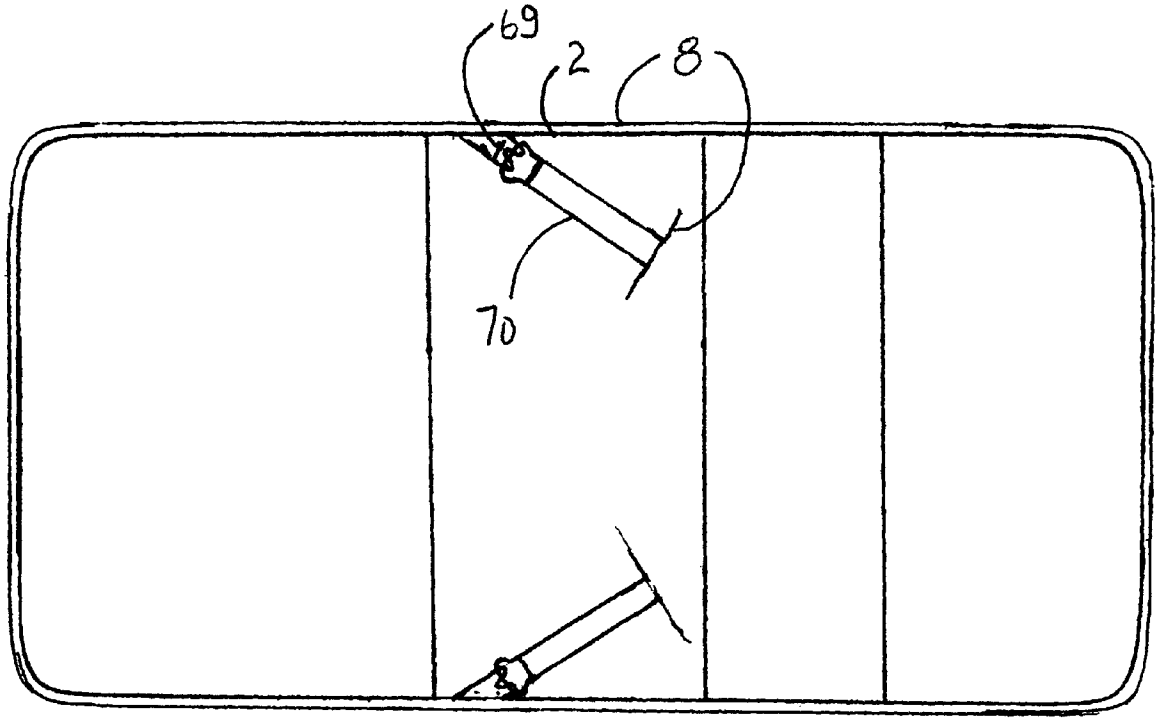
Figure 27:
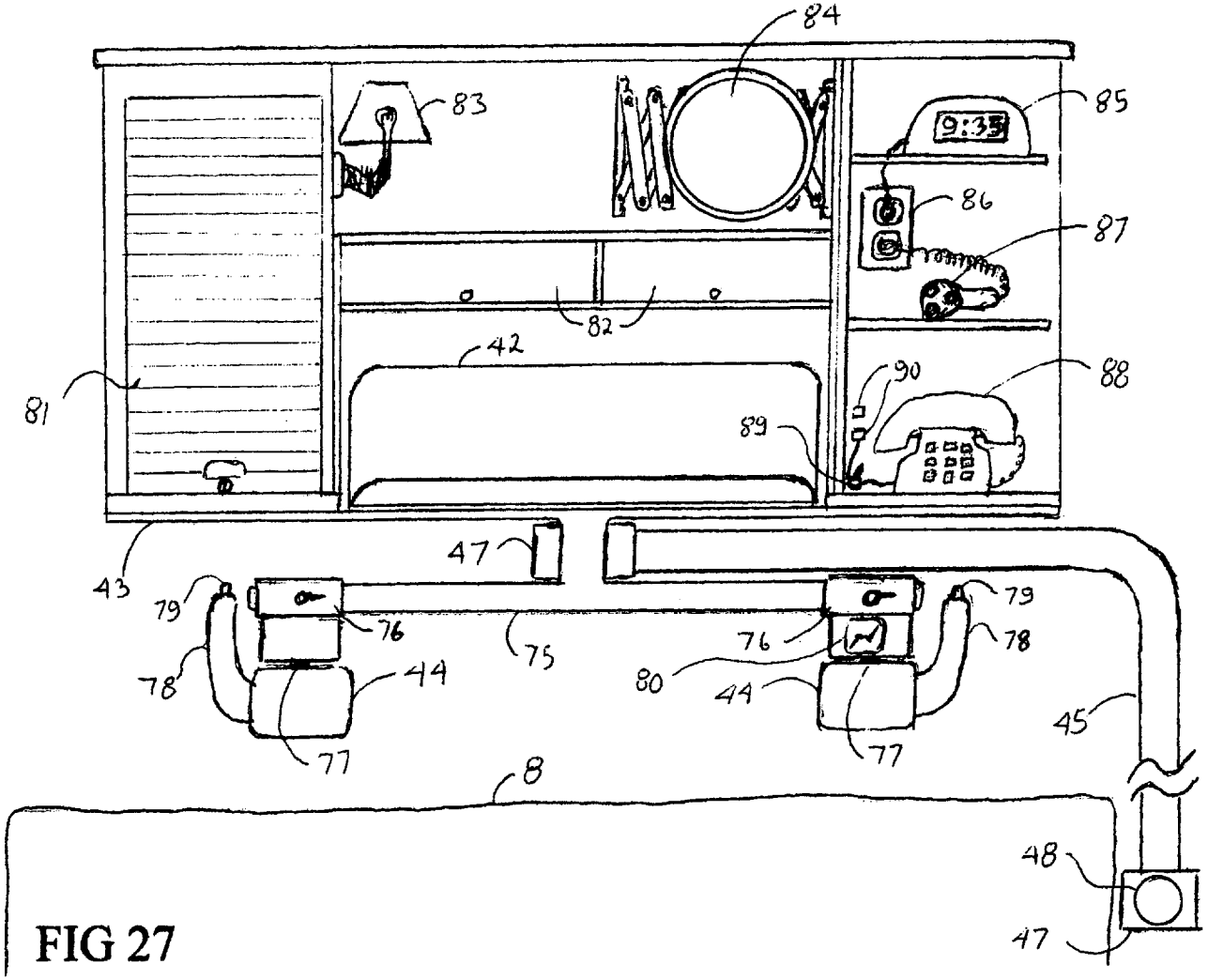
Figure 28A:
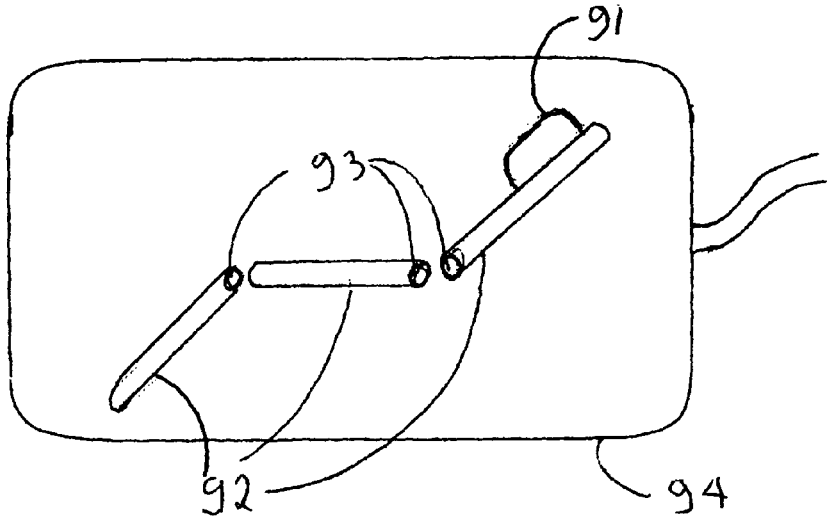
Figure 28B:
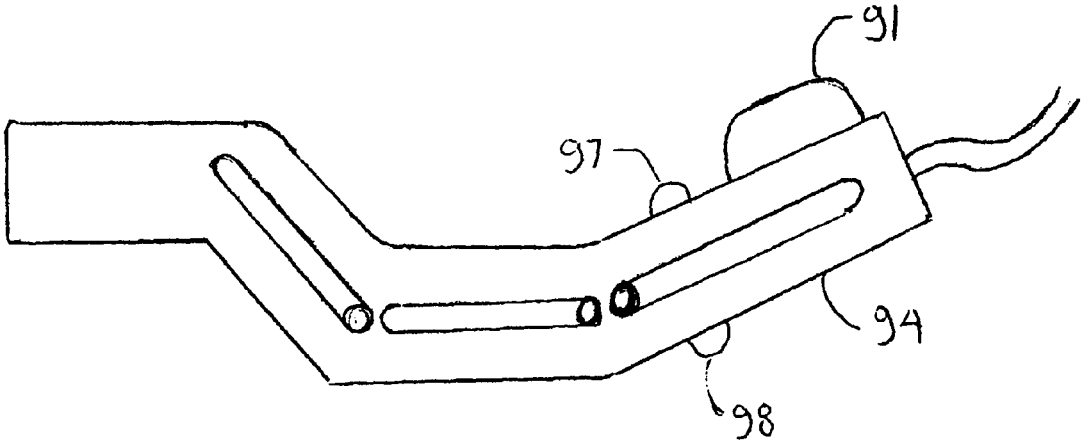

FIG. 18—shows the top view of the three common positions of the desk assembly FIG. 19—shows the top view of the desk assembly, including the armrests, when the user is about to stand up or sit down on the bed FIG. 20—shows a position for viewing television and the safety post FIG. 21—shows a detailed side view of the foot rest mechanism in the elevated position FIG. 22—shows a detailed side view of the foot rest mechanism in the normal position FIG. 23—shows a detailed side view of the foot rest mechanism in the normal position including a second pulley FIG. 24—shows the powered back arch support with linear actuator FIG. 25—shows the top view of the high friction surface FIG. 26—shows the top view of the bed and mattress with releasable clasp FIG. 27—shows the desk assembly FIG. 28A—shows an alternate embodiment of a sensible shape identification control switch FIG. 28B shows a preferred embodiment of a sensible shape identification control switch identifiable by the control housing.

Figure 28C:
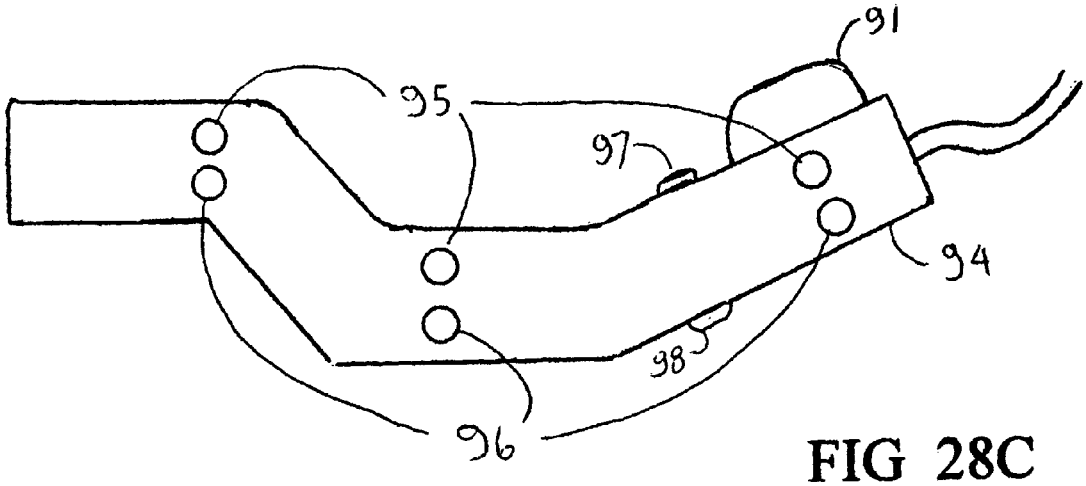
Figure 28D:
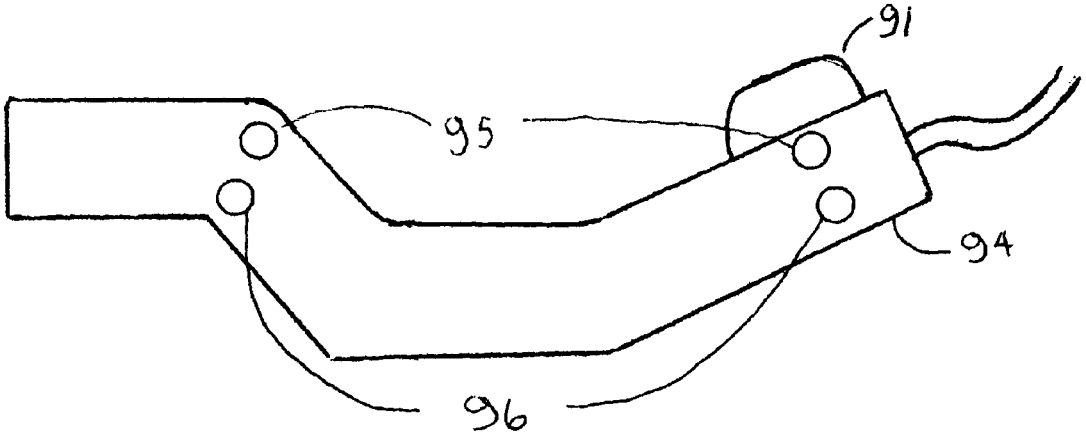
Figure 28E:
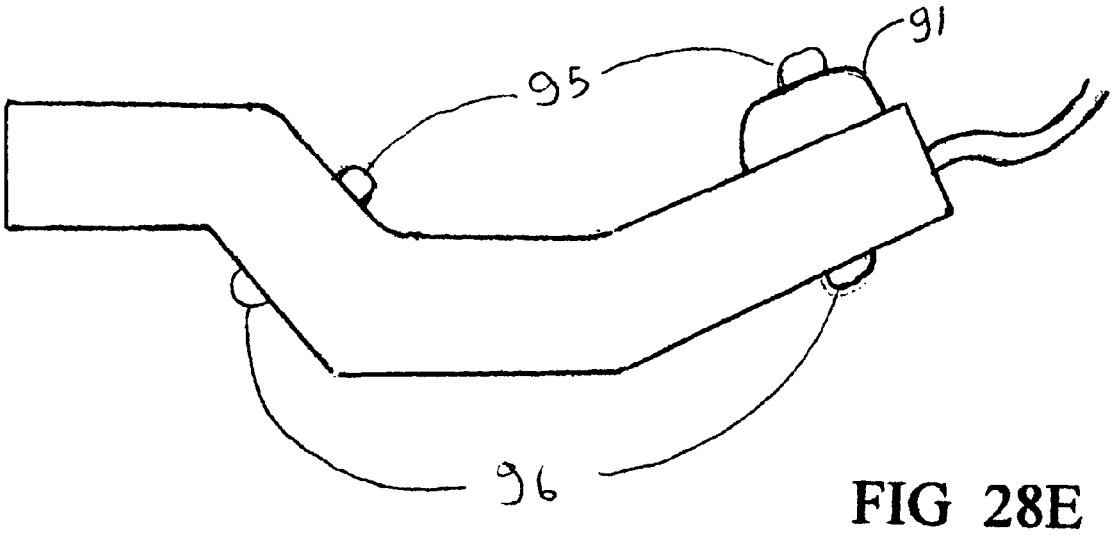
Figure 28F:
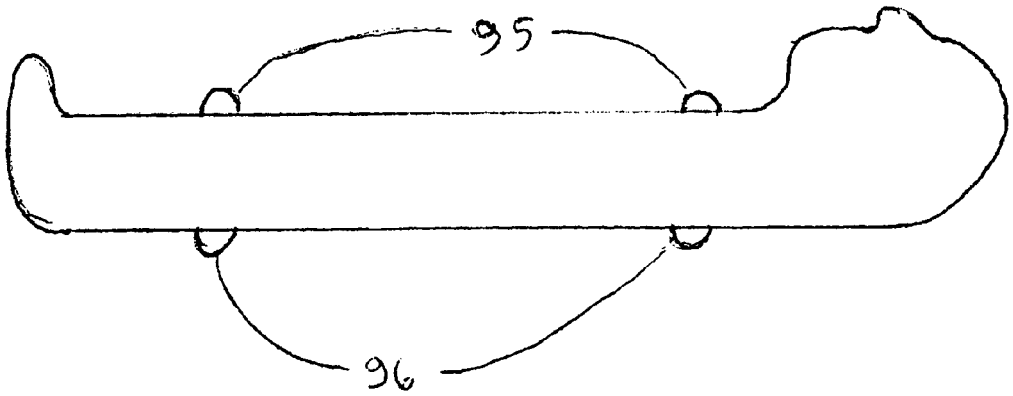

FIG. 28C shows an alternate embodiment of a sensible shape identification control switch where push buttons are used instead of lever switches FIG. 28D shows an alternate embodiment of a sensible shape identification control switch where push buttons are used instead of lever switches to operate a conventional reclining bed without tilting buttocks section FIG. 28E shows an alternate embodiment of a sensible shape identification control switch where push buttons are used to operate a conventional reclining bed without tilting buttocks section with push buttons are placed on represented surface and underside FIG. 28F shows an alternate embodiment of the sensible identification as represented by the human body parts of the head and feet by the shape of the housing.

Figure 29:
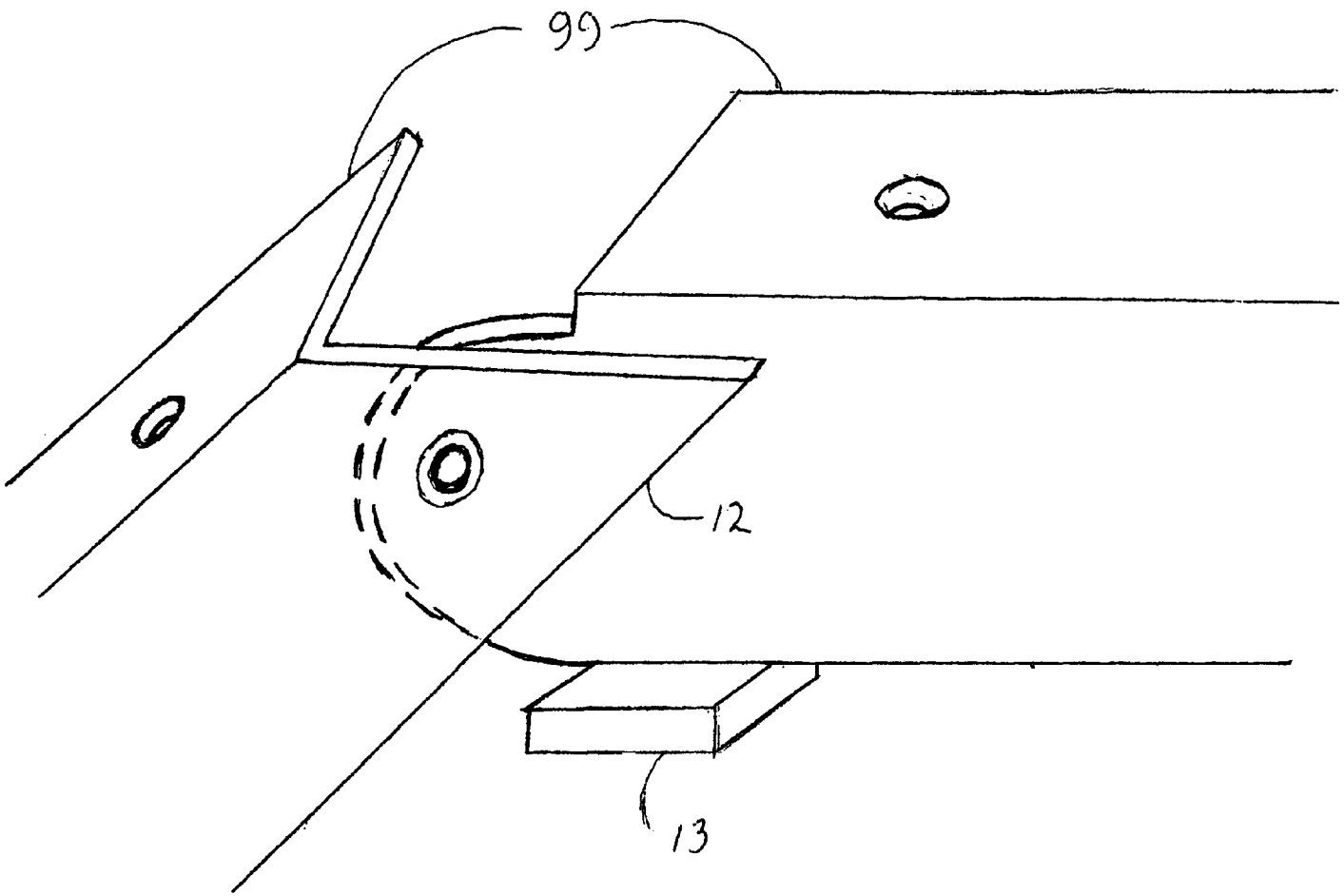

FIG. 29 shows details of stop and protrusion made of structural steel angle bolted to lower side of sections.

Figure 30:
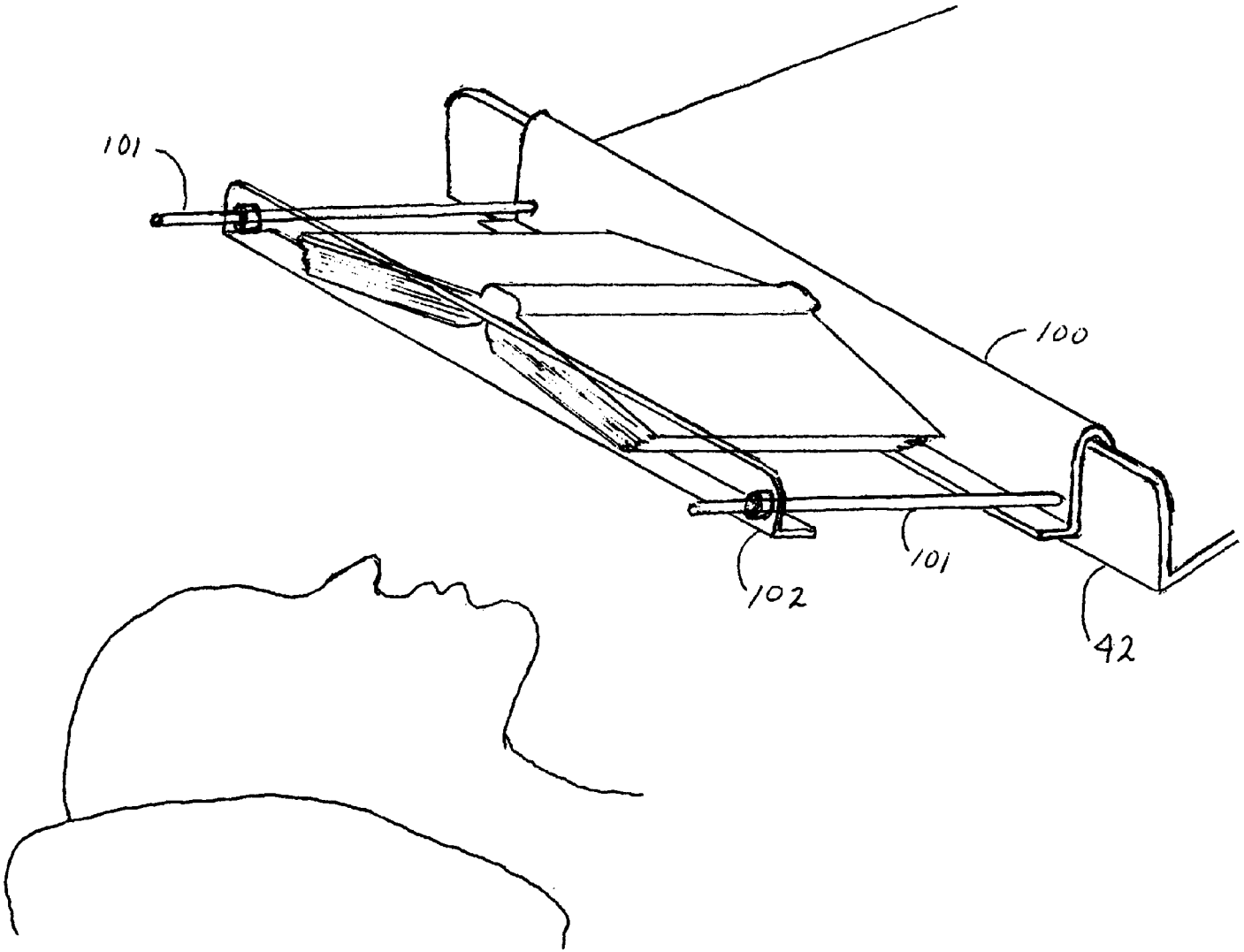

FIG. 30—shows a inverted adjustable book holder that attaches to the desk top 42 for reading in the laying horizontal position.

Figure 31:
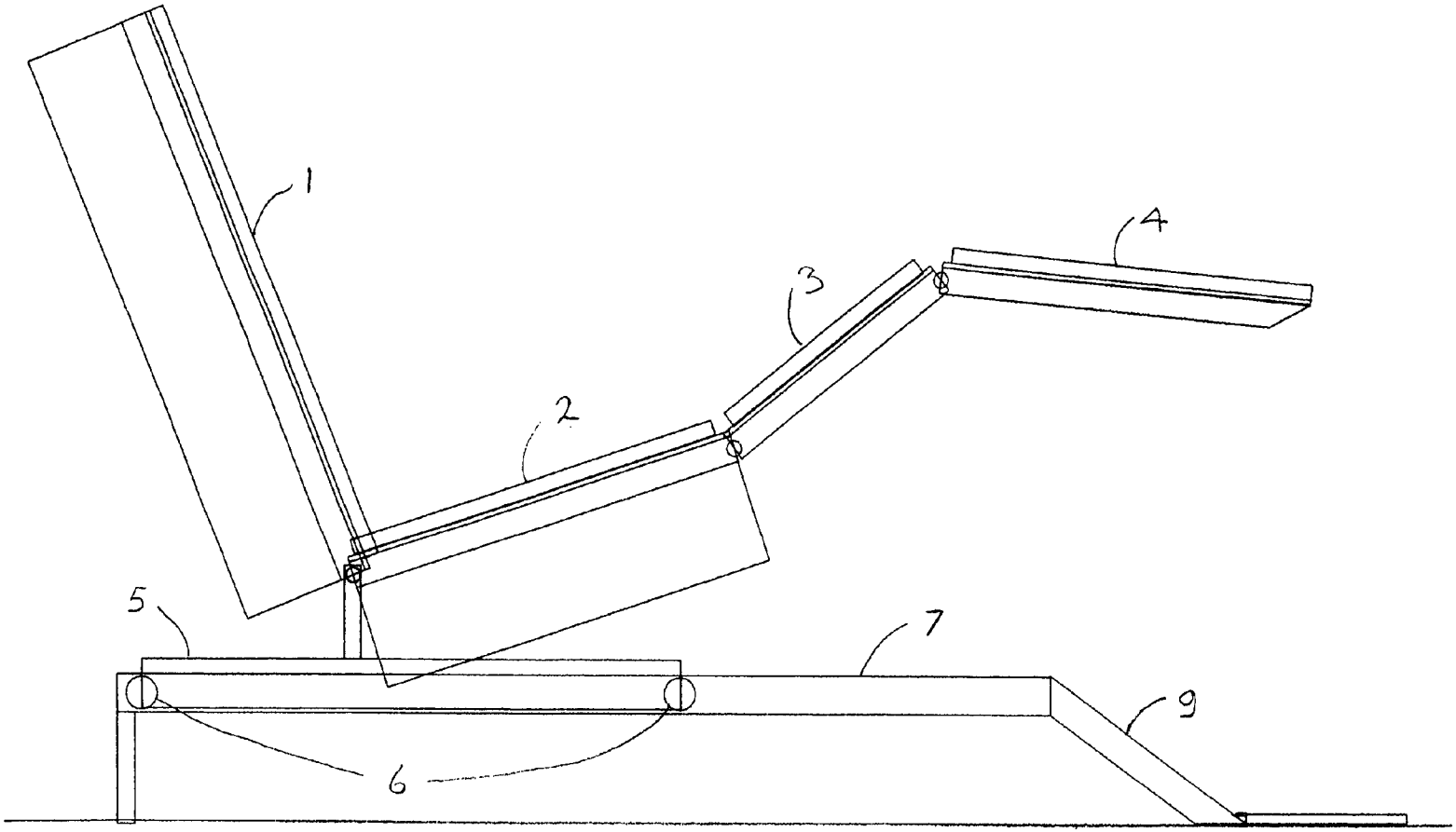

FIG. 31—shows another position configuration that can be made without adding any components.

Figure 32:
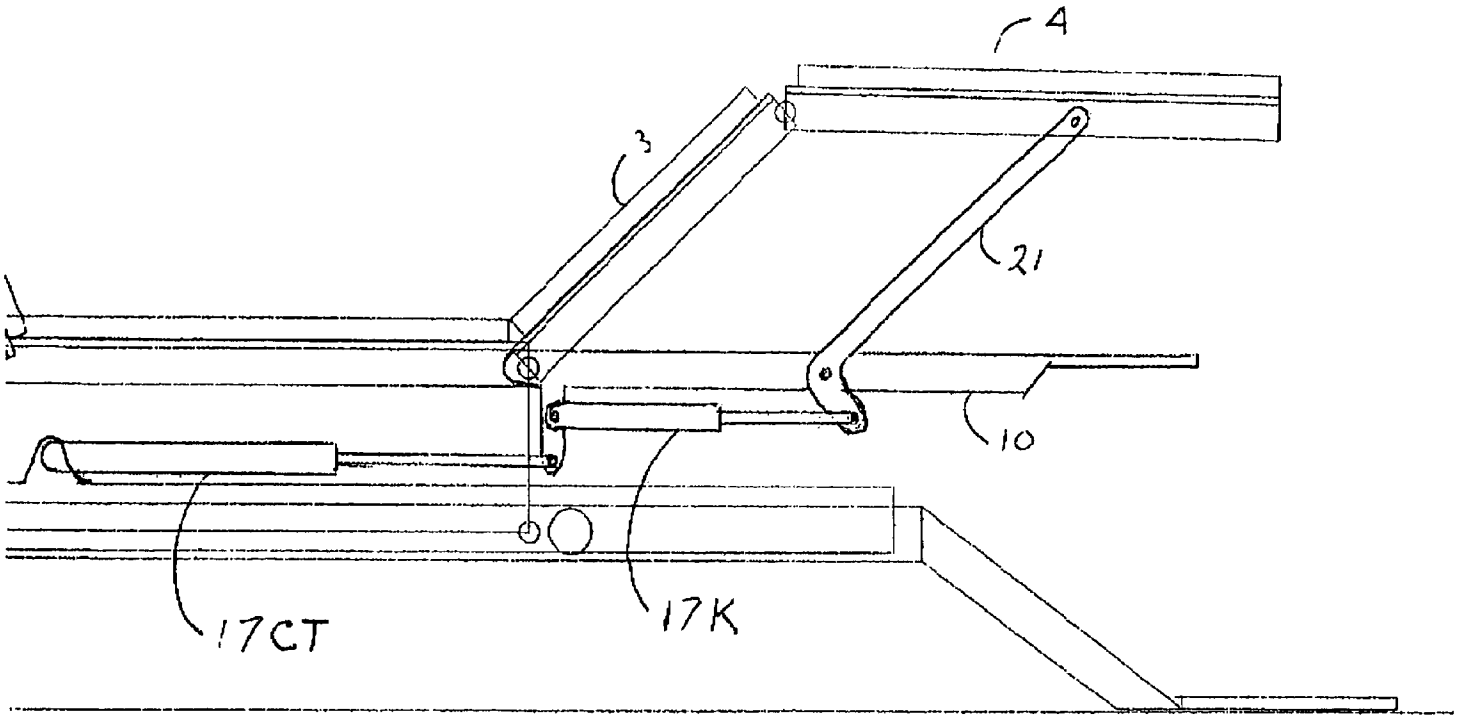

FIG. 32—shows an alternative embodiment using 2 linear actuators for the leg section.

DEFINITIONS OF TERMS bed—a device that holds a conventional mattress of about 80 inches long by 36 inches wide that will lay flat or coplanar in the horizontal position.

wall hugger—a bed that when the back supports reclines remains more or less the same distance from the wall in reference to the top of the back support section. The other sections of the bed move towards the head of the bed while this it is being reclined.

boxspring—is the component that the mattress lies on and may vary in thickness.

collapsible fabric shroud—is the component of the boxspring below the dropping calves and thigh sections and also below the back section that covers and guards the mechanical moving parts and gives the appearance of a conventional boxspring when flat but fabric is pleated to allow for expansion during movement to various positions.

DESCRIPTION—PREFERRED EMBODIMENT

FIG. 1—A preferred embodiment of the present invention of the reclining bed with desk shows the main features of the bed in terms of it's ergonomic advantages that transform the reclining wall hugger be into long term sit-up position equivalent to and exceeding the ergonomic attributes of a comfortable chair, further warranting a desk for long periods of work or recreation.

FIG. 2—Shows the bed sections in the horizontal and sit-up position with the mattress 8 showing the sit up position only and the carriage 5 and carriage wheels 6 with heavier lines in the sit up sit-up location along the track 7 held by frame 9. The numbered sections of the bed are in the sit-up position, and unnumbered sections are in the horizontal position. The back section 1 is pushed up by back bar 24 as the bed moves in the head ward direction as it rotates about the pivot point between the back section 1 and buttocks section 2 while the buttocks section 2 and carriage 5 is rolled along track 7 supported by the frame 9 and it's legs.

FIG. 3—Shows the bed calves section and thigh section mechanism in the feet elevated position including pivot fixture 10, transfer link 11, projection 12 and stop 13, connecting bar 14. Transfer link 11 has three pivot points, lower pivot 16 is connected to the linear actuator 17, the foot end pivot 18 is pivotably connected to the connecting bar 19 and the opposite end of the connecting bar is pivotably connected to said feet elevating mechanism 20. The feet elevating mechanism 20 is composed of the thigh section 3, calves section 4 and feet lifting bar 21. The transfer link fixture pivot 22 is pivotably connected to the pivot fixture 10, the pivot fixture 10 is pivotably connected at the axial pivot location between the buttocks section 2 and thigh section 3. The location of the lower feet lifting bar pivot 23 which is connected to the pivot fixture 10 is the essential location that permits the configuration of the double bar linkage of the feet elevating mechanism 20 to have approximately equal length and parallel spacing of the thigh section 3 and the feet elevating bar 21 (double bars), in order to allow the calves section to remain horizontal during elevation. The lower feet lifting bar pivot 23 would normally be fixed and prevent downward rotation of the thigh section 3, but since this pivot point is moved out of the way by the pivot fixture 10 when the feet are no longer elevated, dropping of the thigh section 3 below horizontal is thus made possible.

While thigh section 3 and calves section 4 are inclined below horizontal, the force of footward motion of the thigh calve and knee linear actuator 17A on the lower pivot point 16 of transfer link 111 results in upward rotation of the pivot fixture 10, calves section 4, thigh section 3, and feet elevating mechanism 20 in an upward direction about the distal end pivot of pivot fixture 10 until the projection 12 of the pivot fixture 10 engages stop 13 secured to thigh section 3 at a substantially horizontal position. Further footward motion of the thigh calve and knee linear actuator 17A results in rotation of the transfer link 11 about the transfer link fixture pivot 22 resulting in lifting of the thigh section 3 and calves section 4 and feet elevating mechanism 20 from resting points on pivot fixture 10 and calves section stop 13. The pivot fixture is preferably constructed of structural steel angle iron with protrusion 12 being part of the angle iron.

FIG. 4—Shows two lock spring 15 in their fully elongated state which prevent the feet elevating mechanism 20 from collapsing onto the pivot fixture 10 if there is a downward force on the calves section 4, and also keeps the pivot fixture 10 horizontal. The two spring 15 also force the transfer link 11 to remain in an over center locked position when feet elevating mechanism 20 is horizontal as well as below horizontal, thus locking the thigh section 3 and calves section 4 and pivot fixture 10 into a single rigid coplanar unit.

FIG. 5—Shows the two lock spring 15 in less elongated or collapsed position but still partially elongated to maintain an over center locked position when feet elevating mechanism 20 is horizontal as well as below horizontal, thus locking the thigh section 3 and calves section 4 and pivot fixture 10 into a single rigid coplanar unit.

FIG. 6—Shows the locked thigh section 3 and calves section 4 and pivot fixture 10 into a single rigid coplanar unit in the sit-up position.

FIG. 7—Shows the disposed locations of the pivots and double bar linkage lengths to form a configuration that will result in substantially minor vertical movement of the foot edge of the calves section 4 of the coplanar configuration of thigh section 3 and calves section 4 when buttocks section 2 is reclined. The lower transfer link pivot 16 is disposed along pivot fixture 10 so that the thigh calve and knee linear actuator 17A (for the thigh section 3 and calves section 4 which remains inactivated) and buttocks section 2 form a double bar linkage resulting headward and footward movement of the foot edge of the calves section 4 during the buttocks section 2 section respectively raising and lowering in inclination with substantially no vertical movement of the foot edge of the calves section 4.

FIG. 8—Shows the buttocks section 2 reclining mechanism with the collapsing boxspring cams. The peripheral frame 25, pivoted at it's distal end pivots, forms the lower edge of the foot end of the bed, and along both sides of the bed at a distance of about 10 inches below the surface of the calves section 4 and/or thigh section 3, covered by fabric (not shown) to give the appearance of a boxspring, to provide a protective elongatable fabric type shroud which encloses the moving parts, and prevent the peripheral frame 25 from resting on bed covers, blankets, sheets and/or floor during horizontal travel. The cam contour controls the elevation position of the peripheral frame 25 when the thigh section 3 and calves section 4 are reclined below the horizontal position and relies on the tensile force of the fabric along the foot edge of the calves section 4 when reclined above the horizontal (feet up position). The buttocks section 2 can be tilted at any position along track 7 as the buttocks section linear actuator 17B for the buttocks section 2 reclining, lower cam arm 27, upper cam arm 26 move with carriage 5. The cam follower 28 rests on the cam portion of the lower cam arm 27 during buttocks section 2 reclining. The lower cam arm 27 is secured to lower cam arm 27 of the opposite side by the cam arm crossbar 29 which is pivoted about carriage 5 when the buttocks section linear actuator 17B is retracted, resulting in an upward movement of the buttocks section 2 by means of the transfer to the two upper cam arm 26 through the common pivot with the two lower cam arm 27.

FIG. 9—shows the bed with the buttocks section 2 horizontal and calves section 4 and thigh section 3 below horizontal. The cam follower 28 is supported by the cam portion of the upper cam arm 26.

FIG. 10—shows the bed with the buttocks section 2, calves section 4, and thigh section 3 horizontal. The cam follower 28 is not touching neither lower cam arm 27 or upper cam arm 26. The peripheral frame 25 is supported by the tensile force of the fabric along the foot edge of the calves section 4.

FIG. 11—shows the fabric covering of the boxspring, and the bed with the buttocks section 2 horizontal, calves section 4, and thigh section 3 in the feet up position. The cam follower 28 is not touching neither lower cam arm 27 or upper cam arm 26 (not shown). The peripheral frame 25 is supported by the tensile force of the fabric along the foot edge of the calves section 4. Side fabric covering 30 is typically heavier density non stretchable fabric requiring expansion pleats 31 that fold inward when bed is horizontal so that it is not visible. The underside fabric 32 is lighter, stretchable fabric to provide safety and is partially along peripheral frame 25 to allow stretching over frame 9 when thigh section 3 and calves section 4 dropped below horizontal.

FIG. 12—shows the side fabric 30 collapsed when the bed is in the sit-up position with the pleats 31 hidden from view. The underside fabric 32 requires minor stretching over frame 9.

FIG. 13—shows the carriage linear actuator mechanism, for back section 1 reclining, connected between the carriage 5 and the frame 9 (See FIG. 14 for details). The threaded rod 33 is rotated by linear actuator drive motor 40. During recline from horizontal to sit-up position of back section 1, the carriage is pushed in the headward direction by the rotating thread 33 forcing the nut 35 into the socket 34 which is secured to the carriage 5. This movement requires significantly higher force than the reclining downward to horizontal since there is the weight of body and back section to elevate. During the recline downward to horizontal, the carriage is pushed in the footward direction by the rotating thread 33 forcing the nut 35 into the thrust ball bearing 36 which pushes against compression spring 37, which pushes against the bushing 39 which pushes against the bearing housing that is secured to the carriage 5. If the back section motion becomes blocked by a body part or blankets, the nut 35 will advance along threaded rod 33 as footward carriage movement is halted resulting in the compression of compression spring 37 until the nut 35 is completely out and disengaged from the socket 34. At this point the threaded rod and nut rotate freely against thrust ball bearing and crushing force is limited to the compression force of the compression spring 37 and the resulting frictional forces between the threaded rod 33, nut 35, and thrust ball bearing 36. After the blockage is removed, the weight of body and back section will move the carriage footward until the nut 35 rests against the socket. Rotation of the threaded rod 33 will then result in the nut 35 seating itself in the socket 34 causing only a minor backward falling motion of the back section 1.

The high frictional surface 41 results in headward direction of slipping of mattress 8 on relatively low friction surface of back section 1, during reclining from horizontal, and forming of mattress to back section 1 and thigh section 2 (rather than the lifting of the mattress 8 from surface), and displacement of mattress 8 past head edge of back section.

FIG. 14—Shows details of FIG. 13 of drive disconnect mechanism. See explanation of FIG. 13.

FIG. 15—shows a side view of the bed with the desk assembly, foot rest assembly and buttocks sling.

The desk top 42 has tilt and height adjustments and extension section to increase versatility of use such as for lap top computer, book holder, writing surface, eating surface, etc. The desk cabinet 43 holds electrical and phone outlets, lamps, alarm clock, storage area for various objects, etc. The arm rests 44 adjusts for width and tilt and fold inward when used as side table or end table. The buttocks sling 50 and back sling 51 are connected to the armrests 44 and may disconnected for sleeping or not in use or if desk is to be swung out of way. The desk assembly height is adjusted by the height adjustment actuator 52 which may be a powered actuator, hand crank or lock pin to lift or lower the column 45 in column base 46. The column base 45 does not rotate within the column base 46. The swivel lock 47 (three shown) has electrically activated lock release and locking device for a rotated column to allow various position locking. The swivel lock 47 would be operated by various switches simultaneously or independently from various locations such as the armrest 44 or desk cabinet 43. The lock and release action of the desk assembly will allow incremental support and hoisting for enter and exit of bed. A person suffering injury or weakness may connect buttocks sling 50 and back sling and then lower buttocks section 2, insert bed pan, or use hands and or feet on mattress to swing themselves over to edge of bed, wheel chair, toilet device, or walking aid. The buttocks section can be raised when sitting over bed edge to release buttocks sling 50 and back sling 51. The base arm 48 swings horizontally about swivel lock 47 secured to frame brace 49, which is secured to frame 9 at near the head end of the bed, the desk assembly to move horizontally to various positions. The column base 46 rotates through the vertical axis of swivel lock 47 allowing desk assembly to move in a horizontal plane relative to and in conjunction with the base arm 48. The swivel lock between the desk top 42 and the top of column 45 allows rotation of the desk top 42, desk cabinet 43 and armrests 44 about the vertical axis of swivel lock 47 allowing desk assembly to move in a horizontal plane and locking of the desk assembly at any point within the horizontal plane and in any orientation. The frame brace 49 may be secured on left or right side of bed since the design of the entire desk assembly is symmetrical. The frame brace may also be secured to the carriage 5.

FIG. 16—shows the buttocks section 2 lowered and the buttocks sling 50 elevated relative to the mattress.

FIG. 17A—shows the top view of the swivel lock details. The solenoid 53 when energized pulls slide lock 55 compressing return spring 54 unlocking spur gear 58 and swivel column 60, to allow rotation about axis 59 within housing 57, until swivel stop and limit 73 meet, which is supported by horizontal arm pipe 56.

FIG. 17B—shows the side view of swivel lock details including electrical cable 71 held by electrical cable clamp 74 at the two points of the swivel column 60 and housing 57 to allow movement without damage to the electrical cable 71.

FIG. 18—shows the top view of the three common positions of the desk assembly, the sit-up desk for working position, side table position for sleeping, and end table or non-use position for enter exit. The dashed line represents the pivotal edge between the back section 1 and buttocks section 2 as if it were in the sit-up position. The frame brace 49 is shown for left or right side attachment of desk assembly.

FIG. 19—shows the top view of the desk assembly, including the armrests 44, when the user is about to stand up or sit down on the bed while it is in the sit-up position with the buttocks section 2 either elevated or horizontal.

FIG. 20—shows a position for viewing television and demonstrates the possible reach and variations of positions anywhere in the horizontal plane of movement. A safety post 61 may be attached directly below the swivel lock 47 extending downward, to say 2 inches above the floor, in the event that the table is at the furthest location from the bed and heavily weighted or if sat upon, to prevent lifting of the bed or damage to the mechanism.

FIG. 21—shows a detailed side view of the foot rest mechanism in the elevated position.

The foot rest 62 moves up the calves section 4 when the buttocks section 3 is elevated by the pulley 66 drawing cable 64 upward causing the cable end and foot rest to move along calves section track 67 in the headward direction while elongating foot rest return spring 63. FIG. 15 shows cleats 65 at different locations to adjust foot rest elevation.

FIG. 22—shows a detailed side view of the foot rest mechanism in the normal position held by partially elongated foot rest return spring 63.

FIG. 23—shows a detailed side view of the foot rest mechanism in the normal position held by partially elongated foot rest return spring 63 including a second pulley 66 to double the movement of the footrest 62 during elevation.

FIG. 24—shows a powered back arch support 68 with lumbar linear actuator 17L.

FIG. 25—shows the top view of high friction surface 41 secured on the buttocks section 2, also seen in side view FIG. 13, showing distance in from side edge of buttocks section 2 to allow insertion of sheets and blankets between the bed surface and the mattress 8. The back section 1 would use a smooth low friction surface such as a polyethylene or vinyl. The high friction surface 41 may be Velcro, rubber, grit, or wire type projections.

FIG. 26—shows the alternate embodiment of top view of the bed and mattress with releasable clasp 69 with strap 70 with one end that is secured on the edge of the buttocks section 2 and the other end of the strap secured to the mattress 8. The sheets would be inserted on top of releasable clasp and strap for insertion up to the mattress attachment point. The strap forces the mattress in the headward direction and prevents slipping down slope of calves section 4 and thigh section 3 while in the sit-up position.

FIG. 27—shows the desk assembly. The arm rest crossbar 75 rotates and locks with the desk cabinet 43. The arm rest 44 can rotate inward about arm rest folding swivel 77. The arm rest adjusters 76 allow adjustment along the arm rest cross bar 75. The desk top 42 can be adjusted for tilt and height and fold out to increase it's area depending on desired use. The open shelf and roll top cabinet are interchangeable for left or right side attachment of desk assembly and accessibility at sidetable and end table. Many different configurations, sizes, shapes such as round etc., are possible. The roll top cabinet may be a medicine cabinet or additional medicine cabinet on rear side.

FIG. 28A—A sensible shape identification control switch for a reclining bed where the control is permanently mounted or hand held, whether the control housing or switch arm 92 has the protrusion 91 represents the pillow or head of a person to sensibly identify the switch for the back section and at the same time identify the orientation of the switch, which in turn identifies the calve/thigh section as not having the head, and in the case of this bed, the buttocks section in the middle. The switch arm 92 is pivoted at the pivot point 93 to which the rotation on the switch arm 92 would correspond to the movement of the back section or calves section thigh section reclining direction. Rotating the switch arm in the protrusion direction about the pivot point 93 direction would cause rotation of the represented section to recline pivotably in an upward direction by causing the linear actuator, which moves that section, to extend or retract until switch arm is released or section limit switch for maximum recline was reached by the section. Rotating the switch arm in the protrusion direction about the pivot point 93 would cause rotation of the represented section to recline pivotably in an upward direction by causing the linear actuator, which moves that section, to extend or retract until switch arm is released or section limit switch for maximum recline was reached by the section. The button 95 on the protrusion side would correspond to the upward rotation of the section. The calves section and thigh section are operated by the same switch throughout the rotation about the thigh section from feet elevated past horizontal to coplanar calves section and thigh section (leg section) down. The back arch support button out 97 and back arch support button in 98 would operate the back arch support mechanism 68.

FIG. 28B is a preferred embodiment similar in function to FIG. 28A except that the shape of the reclined bed is further identified by the control housing 94. The back arch support button out 97 and back arch support button in 98 would operate the back arch support mechanism 68.

FIG. 28C is an alternate embodiment similar in function to FIG. 28B except that push buttons are used instead of lever switches. The reclining in the upward rotation would be the upward button 95 near the pillow or head identified surface, or top of bed, and downward button 96 would be the other button beside (or below) it. The back arch support button out 97 and back arch support button in 98 would operate the back arch support mechanism 68.

FIG. 28D is an alternate embodiment similar in function to FIG. 28C except that only the calves section/thigh section and back section controls are needed to operate a conventional reclining bed without a tilting buttocks section. Push buttons are used instead of lever switches. The reclining in the upward rotation would be the upward button 95 near the pillow or head identified surface, or top of bed, and downward button 98 would be the other button beside (or below) it.

FIG. 28E is an alternate embodiment similar in function to FIG. 28D. The calves section/thigh section and back section operate a conventional reclining bed without tilting buttocks section. Push buttons are placed on represented surface and underside. The reclining in the upward rotation would be the upward button 95 near the pillow or head identified surface, or top of bed, and downward button 96 would be the other button beside (or below) it.

FIG. 28F is an alternate embodiment similar in function to FIG. 28E. The calves section/thigh section and back section operate a conventional reclining bed without tilting buttocks section. Push buttons are placed on represented surface and underside. The reclining in the upward rotation would be the upward button 95 near the pillow or head identified surface, or top of bed, and downward button 96 would be the other button beside (or below) it. The sensible identification is represented by the human body parts of the head and feet. This body identification may also be with used with the other style of switches such as the lever, or may have the representative body housing hinge at the knee and mid section of the housing in the desired direction with internal switches to control the appropriate linear actuators.

FIG. 29 shows details of stop 13 and protrusion 12 made of structural steel angle bolted to lower side of sections. Stop 13 may be eliminated by having horizontal edges butt together.

FIG. 30—shows a inverted adjustable book holder that attaches to the desk top 42 for reading in the laying horizontal position. The book holder base 100 attaches to the desk top 42 or to other places on desks, tables, or lamps etc. The slide arms 101 allow the sliding holder 102 to adjust to the particular book height and allow turning of pages by lifting book slightly while flipping the page.

FIG. 31—shows another position configuration that can be made without adding any components. Other configurations such as this one but with back section horizontal, or just the buttocks section raised, etc., allow person to shift body weight or stretch.

FIG. 32—shows an alternative embodiment using 2 linear actuators for the calve section 4 and thigh section 3. The control of the coplanar calve/thigh section linear actuator 17CT and knee linear actuator 17K could be coordinated by limit switches on the bed to change the power to the appropriate actuator. The pivot fixture 10 and feet lifting bar include attachment points for the coplanar calve/thigh section linear actuator 17CT and knee linear actuator 17K.

| Reference Numerals In Drawings | |
|---|---|
| 1 | back section |
| 2 | buttocks section |
| 3 | thigh section |
| 4 | calves section |
| 5 | carriage |
| 6 | wheel |
| 7 | track |
| 8 | mattress |
| 9 | frame |
| 10 | pivot fixture |
| 11 | transfer link |
| 12 | projection |
| 13 | stop |
| 14 | connecting bar |
| 15 | lock spring |
| 16 | lower transfer link pivot |
| 17 | linear actuator |
| 17A | thigh calve and knee linear actuator |
| 17BK | back section linear actuator |
| 17B | buttocks section linear actuator |
| 17CT | coplanar calve/thigh section linear actuator |
| 17K | knee linear actuator |
| 17L | lumbar linear actuator |
| 18 | foot end pivot |
| 19 | connecting bar |
| 20 | feet elevating mechanism |
| 21 | feet lifting bar |
| 22 | transfer link fixture pivot |
| 23 | lower feet lifting bar pivot |
| 24 | back bar |
| 25 | peripheral frame |
| 26 | upper camarm |
| 27 | lower camarm |
| 28 | cam follower |
| 29 | camarm crossbar |
| 30 | pleats |
| 31 | side fabric |
| 32 | underside fabric |
| 33 | threaded rod |
| 34 | socket |
| 35 | nut |
| 36 | thrust ball bearing |
| 37 | compression spring |
| 38 | bearing housing |
| 39 | bushing |
| 40 | linear actuator drive motor |
| 41 | high friction surface |
| 42 | desk top |
| 43 | desk cabinet |
| 44 | arm rests |
| 45 | column |
| 46 | column base |
| 47 | swivel lock |
| 48 | base arm |
| 49 | frame brace |
| 50 | buttocks sling |
| 51 | back sling |
| 52 | height adjustment actuator |

-continued

| Reference Numerals In Drawings | |
|---|---|
| 53 | solenoid |
| 54 | compressing return spring |
| 55 | slide lock |
| 56 | arm pipe |
| 57 | housing |
| 58 | spur gear |
| 59 | axis |
| 60 | swivel column |
| 61 | safety post |
| 62 | foot rest |
| 63 | foot rest return spring |
| 64 | cable |
| 65 | cleats |
| 66 | pulley |
| 67 | calves section track |
| 68 | back arch support |
| 69 | releasable clasp |
| 70 | strap |
| 71 | electrical cable |
| 72 | shaft ball bearing |
| 73 | swivel stop and limit |
| 74 | electrical cable clamp |
| 75 | arm rest crossbar |
| 76 | armrest adjusters |
| 77 | arm rest folding swivel |
| 78 | hand grip |
| 79 | swivel lock release button |
| 80 | recline control switch |
| 81 | roll top storage cabinet |
| 82 | drawer or cabinet |
| 83 | telescoping lamp |
| 84 | telescoping mirror |
| 85 | alarm clock |
| 86 | 120 volt electrical receptacle |
| 87 | electric shaver |
| 88 | phone |
| 89 | ringer and/or phone disconnect switch |
| 90 | phone jack |
| 91 | protrusion |
| 92 | switch arm |
| 93 | pivot point |
| 94 | control housing |
| 95 | upward button |
| 96 | downward button |
| 97 | back arch support button in |
| 98 | back arch support button out |
| 99 | structural steel angle |
| 100 | book holder base |
| 101 | slide arms |
| 102 | sliding holder |

Objects and Advantages

Accordingly, besides the objects and advantages of the reclining bed with desk described in my above patent, several objects and advantages of the present invention are:

1. The reclining bed has the long felt but unrealized disadvantage of ergonomic discomfort in that the body weight of the thighs was slightly shifted towards the buttocks and lower back area due to thighs and feet being raised beyond horizontal and inclined towards, and thus bearing, onto the buttocks and lower back. At the same time buttocks and lower back are also carrying the weight of the head, shoulders and back that would be transferred to the lower thighs (just above the knee area of the thighs) when sitting up fully in a chair, especially when leaning forward. This is readily felt when reclining in a typical lawn chair where the buttocks section is horizontal, especially when the calve section is also horizontal and no padding is present, even though the bodyweight of the back, head and shoulders is partially supported by the inclined back section. This ergonomic problem is also present with conventional reclining beds but is masked or retarded by the effect of the mattress, and as well as by minimal or partial weight transfer to the lower thigh area when the calves section and thigh section are elevated. However with the back reclined and more so with feet elevated simultaneously (fetal position), for long periods, say one hour, in this position results in discomfort in the lower back and tailbone or buttocks. The fetal position also results in discomfort due to the diaphragm being squeezed by the additional weight not being transferred to the lower thigh area, even though the mattress configuration is similar to the full sit up position, the body is generally horizontal not vertical. The applicant's invention recognizes and solves this problem with a bed that will move into a full sit up position resulting in maximum body weight transfer to the lower thigh area and feet, natural loading on spine and diaphragm, and sitting and breathing in a natural position.
2. The invention maintains the horizontal feet elevation capability of the calves section when feet are raised and allows the calves section and thigh section to recline to lock coplanar horizontally and continue to recline below the horizontal to the floor all in one motion by the same linear actuator. This downward recline is further continued by the tilting upward of the buttocks section while the foot edge stays near the floor. This is even more remarkable that this function of the leg section can be performed by a bed that is a wallhugger, since the entire downwardly recline leg section is moved closer to the wall over and through the bed frame.
3. The adjustable foot rest and also the arm rests and back arch support further alleviates body weight from bearing on the lower back and buttocks area and allows body weight to be shifted to varying areas and variety of body positions by the powered actuators resulting in greater comfort than any existing bed or chair.
4. The invention allows long term sitting without back and buttocks discomfort for entire day use, such as an in an office job situation due to the softer mattress and additional weight distribution area of the calves and the variation of positions not found on office chairs such as reading while laying horizontal.
5. The invention has custom designed desk, that will provide a work place or recreation place now that long term use is possible.
6. The buttocks section tilt eliminates the feeling of forward sliding when back section inclined and thigh section and calves section are horizontal, unlike when buttocks section is horizontal as in conventional reclining beds. The additional feature of tilting the leg section below horizontal with the buttocks section horizontal or tilted, is not possible with existing reclining beds.
7. The invention provides and office sitting area that allows working with the desk at a proper working distance to the body while reclined and/or feet elevated unlike an office desk and reclining chair where the feet elevation would cause knee, feet and armrests to hit underside of desk as well as the entry and exit of person from the extremely difficult unless the chair could be rolled out first.
8. The invention provides a greater variety working body positions and body weight distribution than any office chair and desk combination.
9. Reduced overall length of the bed for small rooms or bachelor apartments where space is limited and no if no room for couch or desk unlike other wall hugger beds that do not provide addition space at feet end of bed.
10. The invention allows a bed of standard boxspring height of about 12-14 inches to hold standard mattresses of about 10 inches resulting in a bed that is at the sitting height when flat as well as comfortable enter and exit height and safe height, or in the event of falling out of bed.

11. Integrated hoist and desk with armrests combines the cost of two separate devices into the one that can be used to assist a person entering or exiting the bed to hoist their body to incremental positions while supporting their body weight on the armrests unlike a crane or gantry. The buttocks sling further makes it possible to lift their body from the mattress surface by lowering the buttocks section and using their hands and/or feet to swing to the side of the bed.

The buttocks sling provides a handicapped or injured person a hoisting and swinging device that is self operated. This would allow a bed pan to be inserted under the partially open sling, personal hygiene, or the person could use their arms, feet and legs to swing themselves over to a toilet or bucket of water while being supported by the buttocks sling and arm rest and a back sling across the rear of the two arm rests. This procedure could also be used as to assist entering and exiting of bed to the stand up position or a wheel chair. The height of a wheel chair is approximately the same as the bed height. The invention's additional positions and ability to shift body weight and buttocks sling to aerate sensitive body areas can prevent bed sores. Thus the bed may also be used for hospitalization purposes as well as everyday office work, or any variation or combination of use.

12. The desk serves also as a side table and end table. The side table is generally not used beside a bed since it blocks the enter and exit area, however with this invention the side table swings out of the way into an end table thereby avoids twisting and reaching to pick up and phone, glass, pen, etc., when used as a desk or side table as compared to an end table. The invention is impact resistant as compared to a mobile table, bed serving tray, side table or end table.
13. The mattress stays secure on boxspring surface but still allows sheets and blankets to be sandwiched between boxspring surface and mattress. This surface is essential due the smaller angle between the back section and buttocks section resulting from the higher back elevation relative to other reclining beds and the additional tilt of the buttocks section and the downward forces on the mattress due to the downward slope of the thigh section and calves section. The mattress conforms to the surface of the boxspring without lifting off the surface even with the smaller angles and climbs up the back section surface unlike other reclining beds where the mattress tends to slide and crush against the foot board.
14. The boxspring's collapsible shroud also acts as a safety shroud and has aesthetic benefit. The same is true for the rear shroud.
15. Sensible controls requires no confusion of reclining control button location but sensibly identifies the upward and downward pivotal movement of each section of the bed relative to the head of the bed which is identified by the pillow or head simulation protrusion. This is essential in the dark, or in a drowsy mental state.
16. Provision of a place for a readily available mirror and electric shaver, make up, safe storage for medication, allowing reduced bathroom time and storage space as well as a more comfortable alternative place for these activities.
17. Power back arch support further improves and allows change of position and adjustments to be made for long term seating.
18. Standard bed appearance is maintained for marketability and aesthetics.
19. The desk is superior to a bed tray, resting on thighs, or mobile hospital bed table in the following ways:
    - the desk is easily moved into position even while in bed unlike tables with four swivel castor wheels require moving from a "twisted spine while seated" position
    - the table swivel castored wheels under the be cannot be easily locked by a second person
    - the table cannot be used as a support for entering and exiting the bed, but is actually a hindrance or obstacle preventing enter or exit
    - a bed tray which must be either served by a second person or place on a table beside the bed and require twisting and lifting from a "twisted spine seated" position
    - impact resistant as compared to a mobile table, bed serving tray, side table or end table
    - lap top computers and books are ergonomically uncomfortable as they require looking down when on the lap, the key board angle is flat in stead of tilted up, and there is no wrist rest area or arm rest
    - the person's thigh may not be shifted for change or variety of position
    - holding the book to elevate it is tiresome, especially without armrests.
    - wall plug, phone plug are easily accessible where mobile hospital table would be very difficult to maneuver if it has wires attached to it which would dangle from the table onto the floor
    - alarm clock can be set from the in bed position Operation —Bed positioning—

The switch arm 92 is pivoted at the pivot point 93 to which the rotation on the switch arm 92 would correspond to the movement of the back section or calves section thigh section reclining direction. Rotating the switch arm in the protrusion direction about the pivot point 93 would cause rotation of the represented section to recline pivotably in an upward direction by causing the linear actuator which moves that section to extend or retract until switch arm is released or section limit switch for maximum recline was reached by the section. The button 95 on the protrusion side would correspond to the upward rotation of the section. The calves section and thigh section are operated by the same switch throughout the rotation about the thigh section from feet elevated past horizontal to coplanar calves section and thigh section (leg section) down. The back arch support button out 97 and back arch support button in 98 would operate the back arch support mechanism 68. For instance, the switch arm 92 on the control housing 94 having, protrusion 91 which represents a pillow, is pushed upward to cause the back section linear actuator 17BK to retract, pulling the carriage 5 headward which causes the back bar 24 to elevate the back section 1 until the switch arm 92 is released. To lower the back section, the switch arm 92 is pushed downward to cause the back section linear actuator 17BK to expand pushing the carriage 5 footward which causes the back bar 24 to lower the back section 1 until the switch arm 92 is released. The back section linear actuator 17BK will automatically stop when either end of it's stroke is reached. This operation is similar for the other linear actuators and their corresponding sections that they move.

The arm rests 44 adjusts for width and tilt and fold out of way when unlocked and rotated horizontally about arm rest folding swivel 77 when the desk is used as side table or end table. The arm rests are locked into the sitting position for entry and exit. To use the desk assembly to enter the bed, for a person requiting maximum support, the person would maneuver their wheel chair to the bedside near the thigh section 3 and calves section 4 pivot edge, facing the feet end of the bed, and then swing the desk assembly over their wheel chair. The buttocks sling 50 should already be under their buttocks in the wheelchair from their initial entrance, if not then it should be positioned under them. The ends of the buttocks sling 50 and back sling 51 are secured onto the arm rests 44 and the upward force of the height adjustment actuator will lift the person out of the wheel chair. The wheel chair is rolled out from under them and the swivel lock release button 79 pushed and locked "on" so that both hands and feet may be used to maneuver one's self and desk assembly into center of the mattress with the buttocks section 2 horizontal, and the back section 1 reclined. (The calves section 4 and thigh section 3 may be up but preferably down). The buttocks section 2 is tilted upward by activating the back section lever or push button lifting the person and slackening the buttocks sling 50 ends which are then unsecured and then back sling 51 unsecured. The slings may be left in place for future exit of bed, which is the reverse of entering.

To use the desk assembly to enter the bed, for a person requiring partial support, the person would position oneself between the armrests (buttocks sling 50 and back sling 51 may also be secured at this point if needed) and hold the two hand grips 78. The swivel lock release buttons may be configured to release one or more of the swivel locks 47. Both buttons have to be pushed in three depths to filly release all the swivel locks 47 allowing the person to maneuver body and desk assembly to the bedside near the thigh section and calves section pivot edge, facing away from the bed, with the buttocks section 2 horizontal, and the back section 1 reclined. (The calves section 4 and thigh section 3 may be up but preferably down). The buttocks section 1 is tilted by activating the bask buttocks section lever or push button lifting the person from their feet while the swivel locks are locked to allow stability.

The person then can shift their body weight and buttocks by resting it on their elbows and forearms on the armrest 44, and sliding their buttocks towards the center of the mattress as far as they can by using their legs and feet to push on the foot rest and the mattress. The swivel locks are then released and the desk assembly positioned further towards the center of the bed and then locked again. This procedure is repeated until they are in position. The buttocks section 2 or the height adjustment actuator 52 can also be lowered and raised to assist in shifting the body weight to the elbows and forearms. A powered rotary actuator can be added to the swivel locks 47 to assist in the horizontal movements, but is not preferred due to low resistance of the ball bearings, complexity and cost, but for a person with weak arms and without the use of their lower body, it may be essential and offered as an option.

A sensible shape identification control switch for a reclining bed where the control is permanently mounted or hand held, whether the control housing or switch arm 92 has the protrusion 91 represents the pillow or head of a person to sensibly identify the switch for the back section and at the same time identify the orientation of the switch, which in turn identifies the calve/thigh section as not having the head, and in the case of this bed, the buttocks section in the middle. The switch arm 92 is pivoted at the pivot point 93 to which the rotation on the switch arm 92 would correspond to the movement of the back section or calves section/thigh section reclining direction. Rotating the switch arm in the protrusion direction about the pivot point 93 would cause rotation of the represented section to recline pivotably in an upward direction until released or section limit switch for maximum recline was reached by the section. The button 95 on the protrusion side would correspond to the upward rotation of the section. The calves section and thigh section are operated by the same switch throughout the rotation about the thigh section from feet elevated past horizontal to coplanar calves section and thigh section (leg section) down. The back arch support button out 97 and back arch support button in 98 would operate the back arch support mechanism 68.

The inverted adjustable book holder that attaches to the desk top 42 for reading in the laying horizontal position. The book holder base 100 attaches to the desk top 42 or to other places on desks, tables, or lamps etc. The slide arms 101 allow the sliding holder 102 to adjust to the particular book height and allow turning of pages by lifting the book slightly.

CONCLUSIONS, RAMIFICATIONS AND SCOPE

Accordingly, the reader will see that the reclining bed with the novel feature that allows a person to sit up and having all the ergonomic benefits of foot and arm rests and back arch support to allow for long periods in the bed. This is further enhanced by the ergonomic benefits of power adjusted positions of reclining beds to shift body weight to a variety of positions, such as writing or reading at a desk in a reclined position, which is unobtainable with a chair and desk. The invention has made the bed a comfortable place to sit which, in turn, demands the apparatus to facilitate long time periods of work and recreation. The desk is made to fit the new bed now that a desk is needed. The invention has made the desk an integral part of the bed just as the chair has been part of the desk, the chair however being limited in it's ergonomic functions such as reclining with feet up while still being close enough to the working surface, as well as having blankets or laying flat. The bed is also made into an extension of the bathroom for such things as cosmetic application or electric shaving both requiring vertical seating, mirror, lighting and electrical power and storage compartments, including medicines cabinet. This bed offers many benefits to handicapped or seriously injured people and increases the 'dependency' boundary so that marginally hospitalized or institutionalized people can now be independent.

Thus the scope of the invention should be determined by the appended claims and their legal equivalents, rather than by the examples given.

I claim:

1. A multi-position reclining bed comprising:

a. a horizontally situated elongated track secured to, and forming part of a stationary frame b. a plurality of supporting elements positioned above and overlying said track, forming a horizontal plane of the bed when all said supporting elements are positioned horizontal, and moveably coupled thereto, and comprising:

i. a back section, moved by back linear actuator;

ii. a buttocks section, moved by a buttocks linear actuator; and iii. a coplanar thigh/calve section, moved by a coplanar thigh/calve linear actuator said supporting elements being pivotably connected to each other at abutting edges and c. said back linear actuator coupled to said back section of said supporting elements and to said track and configured to move an end portion pivotably about said buttocks section when said back linear actuator is activated, such that when said back section is raised or lowered, said end portion remains substantially the same distance from an adjacent wall, and wherein said coplanar thigh/calve section of said supporting elements reclines pivotally below the horizontal plane of the bed in a downward direction pivotally about an adjoining edge with said buttocks section of said supporting elements, and wherein said supporting elements move in conjunction along said track d. a mattress that overlies and is supported by said plurality of supporting elements.

2. The multi-position reclining bed of claim 1 further including structure for independent movement of the said coplanar thigh/calve section comprising; an independent thigh section and an independent calve section, and a knee linear actuator, a pivot fixture coupled to said coplanar thigh/calve linear actuator, and said knee linear actuator coupled to knee elevation support members, wherein;

said pivot fixture is pivotally connected to said buttocks section to provide a fixed pivot for said knee elevation support members, said coplanar thigh/calve linear actuator moves said coplanar thigh/calve section, when locked in a coplanar configuration, pivotably about said buttocks section when below the horizontal plane of said bed, and wherein, when horizontal, said knee linear actuator locks and unlocks said independent thigh. and said independent calve sections to move said independent thigh section and said independent calve section pivotably about each other while structurally supported by said knee elevation support members and said pivot fixture when above the horizontal plane of said bed.

3. The multi-position reclining bed of claim 1 wherein said thigh/calve section, when in a planar resting position horizontal with the horizontal plane of bed, extends beyond said track, whereby said coplanar thigh/calve section is provided clearance to drop below the horizontal plane of said track when said back section is elevated.

4. The multi-position reclining bed of claim 1 further including a carriage having track wheels wherein said carriage rolls along said track and pivotably supports said buttocks section and said back section along adjoining edges with said buttocks section wherein said coplanar thigh/calve section is cantilever supported by adjoining said buttocks section edge and said thigh/calve section linear actuator and wherein said thigh/calve section linear actuator is supported by said carriage whereby said track does not interfere when lowering said coplanar thigh/calve section to floor.

5. The multi-position reclining bed of claim 1 further comprising a footrest located at the bottom end of said coplanar thigh/calves section and a foot rest actuating mechanism wherein said footrest is moved upward along length of said coplanar thigh/calves section by said foot rest actuating mechanism to support feet of person while sitting in said bed, and moved downward along length of said coplanar thigh/calves section by said foot rest actuating mechanism to allow clearance of feet. of person sleeping in the bed when laying horizontal.

6. The multi-position reclining bed of claim 1, wherein said buttocks linear actuator and said buttocks section form a double bar linkage resulting in substantially minor vertical movement of the lower edge of the calves section of said coplanar thigh/calves section as said buttocks section is reclined.

7. The multi-position reclining bed of claim 1 further comprising a box spring having a reduced thickness at the lower edge of said coplanar thigh/calves section wherein said box spring allows top surface of said coplanar thigh/calves section to lower within close proximity of floor.

8. The multi-position reclining bed of claim 1, further including a plurality of surfaces with varying coefficients of friction on said bed surface wherein a first said surface of high coefficient of friction grips buttocks portion of said mattress, and a second said surface of low coefficient of friction allows back portion of said mattress to slide along said back section.

9. The multi-position reclining bed of claim 1, further including a releasable mechanical holding device wherein said releasable mechanical holding device secures the said mattress to top of said supporting elements.

10. The multi-position reclining bed of claim 9, wherein said releasable mechanical holding device is located at a sufficient distance from the perimeter of said mattress to avoid interference with the placement of sheets and/or other bedding materials beneath perimeter edge of said mattress.

11. The multi-position reclining bed of claim 1, further comprising a powered mechanism located behind said back section wherein said powered mechanism pushes lower back portion of said mattress forward from said back section surface.

12. A multi-position reclining bed comprising:

i. a mattress supporting back section and back section linear actuator ii. a mattress supporting element being pivotal connected to said mattress supporting back section at abutting edge iii. a singular swing arm iv. two armrests, v. a mattress vi. a stationary frame wherein said mattress supporting back section and said mattress supporting element are supported by said stationary frame and form a horizontal support for said mattress and said back section linear actuator coupled to said back section and to said stationary frame configured to move said back section pivotably about said mattress supporting element when said back linear actuator is activated, and wherein said singular swing arm is pivotably attached to said stationary frame and wherein said two arm rests are attached to said singular swing arm and are substantially parallel to each other, and wherein said swing arm can swing horizontally over said mattress and side of said mattress.

13. The multi-position reclining bed of claim 12 further including a swivel lock wherein said swing arm is capable of locking into a stationary position by said swivel lock.

14. The multi-position reclining bed of claim 12 further comprising a desk wherein said desk is attached to said swing arm.

15. The multi-position reclining bed of claim 12 further comprising electrical and data connections, wherein said electrical and data connections are secured to said swing arm whereby they accessible to the occupant of the bed.

16. The multi-position reclining bed of claim 12 further including a buttocks sling, a mattress supporting buttocks section and a buttocks linear actuator;

wherein said mattress supporting back section, mattress supporting buttocks section and said mattress supporting element are supported by said stationary frame and form a horizontal support for said mattress and;

said back section linear actuator coupled to said back section and to said stationary frame configured to move said back section pivotably about said buttocks section when said back linear actuator is activated, and;

said buttocks section, being pivotably connected at abutting edges of said back section and said mattress supporting element, and said buttocks section linear actuator coupled to said buttocks section and said stationary frame, said buttocks section linear actuator coupled to said buttocks section and to said stationary frame configured to move said buttocks section pivotably about said back section when said buttocks linear actuator is activated, and wherein said buttocks sling is secure to said two armrests whereby a person can be suspended by said buttocks sling secured to said two armrests above surface of said bed when lowering said buttocks section.

17. The multi-position reclining bed of claim 12 further including a height adjustment actuator secured to said swing arm wherein said height adjustment actuator lowers and raises said swing arm.

* * * * *